US011167167B1

(12) United States Patent
Weng

(10) Patent No.: US 11,167,167 B1
(45) Date of Patent: Nov. 9, 2021

(54) WEIGHT-ADJUSTABLE DUMBBELL COMPONENT WITH LOCKING MECHANISM

(71) Applicant: Gaowang Weng, Zhejiang (CN)

(72) Inventor: Gaowang Weng, Zhejiang (CN)

(73) Assignee: Gaowang Weng, Yongkang (CN)

( * ) Notice: Subject to any disclaimer, the term of this patent is extended or adjusted under 35 U.S.C. 154(b) by 0 days.

(21) Appl. No.: 17/339,712

(22) Filed: Jun. 4, 2021

(30) Foreign Application Priority Data

| | | |
|---|---|---|
| Jul. 14, 2020 | (CN) | 202021376529.0 |
| Sep. 7, 2020 | (CN) | 202021925036.8 |
| Sep. 7, 2020 | (CN) | 202021933114.9 |
| Sep. 13, 2020 | (CN) | 202021989220.9 |
| Sep. 13, 2020 | (CN) | 202021989246.3 |
| Sep. 24, 2020 | (CN) | 202022121317.4 |
| Oct. 31, 2020 | (CN) | 202011196695.7 |
| Oct. 31, 2020 | (CN) | 202011199837.5 |
| Oct. 31, 2020 | (CN) | 202022475800.2 |
| Oct. 31, 2020 | (CN) | 202022475802.1 |

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/075
See application file for complete search history.

(56) References Cited

U.S. PATENT DOCUMENTS

| | | | | |
|---|---|---|---|---|
| 7,261,678 | B2 * | 8/2007 | Crawford | A63B 21/0607 482/107 |
| 10,518,123 | B2 * | 12/2019 | Moran | A63B 21/075 |
| 2004/0005968 | A1 * | 1/2004 | Crawford | A63B 21/0607 482/106 |
| 2007/0184945 | A1 * | 8/2007 | Lin | A63B 21/075 482/107 |
| 2008/0026921 | A1 * | 1/2008 | Liu | A63B 21/063 482/107 |
| 2010/0184570 | A1 * | 7/2010 | Cheng | A63B 21/0728 482/107 |
| 2010/0323856 | A1 * | 12/2010 | Svenberg | A63B 21/075 482/108 |

(Continued)

*Primary Examiner* — Joshua Lee
(74) *Attorney, Agent, or Firm* — Dragon Sun Law Firm, PC; Jinggao Li, Esq.

(57) ABSTRACT

The present invention discloses a weight-adjustable dumbbell component with a locking mechanism, comprising a dumbbell component, a dumbbell seat and a plurality of dumbbell pieces placed at two sides of the dumbbell seat. The dumbbell seat comprises a handle component, tailstock components disposed at two sides of the handle component and two sliders movably connected to two ends of the handle component. Rotating the handle component can drive the sliders to move slidably in a rotation stopping groove. By disposing a guiding groove inside a handle tube, a guiding block at one end of one of the sliders is mounted inside the guiding groove and the guiding groove inside the handle tube can pull the one of the sliders to move leftward or rightward.

10 Claims, 21 Drawing Sheets

(56) References Cited

U.S. PATENT DOCUMENTS

| | | | | |
|---|---|---|---|---|
| 2012/0021877 | A1* | 1/2012 | Lundquist | A63B 21/075<br>482/107 |
| 2013/0231224 | A1* | 9/2013 | Svenberg | A63B 21/0724<br>482/107 |
| 2013/0324375 | A1* | 12/2013 | Svenberg | A63B 21/0728<br>482/108 |
| 2014/0349820 | A1* | 11/2014 | Wang | A63B 21/0726<br>482/108 |
| 2015/0367163 | A1* | 12/2015 | Moran | A63B 71/0036<br>482/108 |
| 2018/0078810 | A1* | 3/2018 | Chen | A63B 21/075 |
| 2018/0264308 | A1* | 9/2018 | Wang | A63B 71/0036 |
| 2020/0398100 | A1* | 12/2020 | Wang | A63B 21/0726 |

* cited by examiner

WEIGHT-ADJUSTABLE DUMBBELL COMPONENT WITH LOCKING MECHANISM

CROSS-REFERENCE TO RELATED APPLICATIONS

This application claims priorities from the Chinese patent applications 2020111966957, filed Oct. 31, 2020, 2020111998375, filed Oct. 31, 2020, 2020224758021, filed Oct. 31, 2020, 2020224758002, filed Oct. 31, 2020, 2020219892209, filed Sep. 13, 2020, 2020219331149, filed Sep. 7, 2020, 2020213765290, Jul. 14, 2020, 2020219892463, filed Sep. 13, 2020, 2020221213174, Sep. 24, 2020, and 2020219250368, filed Sep. 7, 2020, the content of which are incorporated herein in the entirety by reference.

TECHNICAL FIELD

The present invention relates to the technical field of fit equipment and particularly a weight-adjustable dumbbell component with a locking mechanism.

BACKGROUND

Dumbbells are common and easy fit equipment and are mainly used for grasping by hands of a user so as to make arms of the user stronger.

However, old-fashioned dumbbells are integrally molded, such that counterweight thereof cannot be changed. As a result, when a user intends to use dumbbells of different weight, the user has to buy a plurality of dumbbells with different weight, resulting in problems like too high expenses and inconvenient intake of excessive number of dumbbells.

SUMMARY

The present invention aims to provide a weight-adjustable dumbbell component with a locking mechanism so as to solve the technical problem in the background art that old-fashioned dumbbells are integrally molded, such that counterweight thereof cannot be changed. As a result, when a user intends to use dumbbells of different weight, the user has to buy a plurality of dumbbells with different weight, resulting in too high expenses and inconvenient intake of excessive number of dumbbells etc.

In order to realize the above purpose, the present invention provides the following technical solution: a weight-adjustable dumbbell component with a locking mechanism, comprising a dumbbell component, a dumbbell seat and a plurality of dumbbell pieces placed at two sides of the dumbbell seat, wherein the dumbbell component comprises a handle component, tailstock components disposed at two sides of the handle component and two sliders movably connected to two ends of the handle component, the handle component is rotatably connected between two tailstock components, the handle component comprises a handle tube, wherein the handle tube is a hollow tube and two guiding grooves with opposite bolt directions are disposed at an inner wall of the handle tube, each of the sliders comprises a pipe sleeve, wherein one end of the pipe sleeve close to the handle component is provided with a guiding block and the other end thereof is provided with a rotation stopping block, the tailstock components are provided with rotation stopping grooves thereon, the guiding block is slidably mounted inside one of the guiding grooves, the rotation stopping block is mounted inside one of the rotation stopping grooves, rotating the handle component can drive the sliders to move slidably inside the rotation stopping grooves, each of the tailstock components comprises a tailstock rear cover provided with the rotation stopping grooves and a fixing shaft disposed inside the handle tube in a penetrating manner, middle parts of the dumbbell pieces are provided with fixing holes for insertion of the sliders, upper ends of the fixing holes are provided with opening grooves communicating therewith, a width of the opening grooves is smaller than a diameter of the sliders, and the width of the opening grooves is greater than a diameter of the fixing shaft.

Preferably, each of the tailstock components further comprises a tailstock front cover and a tailstock inner cover, wherein the tailstock front covers are fixedly mounted to two sides of the handle tube and can rotate synchronously with the handle tube, one side of the tailstock front cover remote from the handle tube is provided with a plurality of limiting grooves, a lower end of the tailstock inner cover is slidably connected with a stop, the stop can be clamped into the limiting grooves to limit rotation of the handle component relative to one of the tailstock components.

Preferably, the handle component comprises a limiting iron plate capable of rotating synchronously with the handle tube, the limiting iron plate is bolt-connected to the handle tube, an outer side of the limiting iron plate is fixedly connected with a rotating disk, the rotating disk is of a round shape and is provided with a plurality of limiting grooves thereon, each of the tailstock components comprises a tailstock front cover and a tailstock inner cover, the limiting iron plate and the rotating disk are disposed between the tailstock front cover and the tailstock inner cover, a lower end of the tailstock inner cover is slidably connected with a stop, the stop can be clamped in the limiting grooves to limit rotation of the handle component relative to one of the tailstock components.

Preferably, a lower end of the tailstock inner cover is provided with a mounting groove, the stop is movably mounted inside the mounting groove, and a return spring is mounted between the stop and the mounting groove, the return spring forcing the stop to press into the limiting grooves.

Preferably, a middle part of the stop is provided with a clamping groove, a top end of the stop is provided with a placing hole, upper and lower end surfaces of the stop and upper and lower end surfaces of the clamping groove all have a shape of circular arc, an inner circular ring of the rotating disk is provided with a plurality of limiting grooves, the rotating disk is disposed inside the clamping groove, one end of the return spring is mounted inside the placing hole and the other end of the return spring abuts against a top end of the mounting groove.

Preferably, an inner side surface of the mounting groove is provided with an opening groove, an upper end surface of the mounting groove is provided with a fixing groove, a locking mechanism is mounted inside the mounting groove, the locking mechanism comprises a return spring and a stop, two ends of the stop are provided with rotary pins, a front side of the stop is provided with a bump, a rear side of the stop is provided with a clamping block, a lower end surface of the stop is provided with a recess, the stop is rotatably mounted inside the opening groove through the rotary pins, an upper end of the return spring is mounted inside the fixing groove, and a lower end of the return spring is fixed on the bump, an outer circular ring of the rotating disk is provided with a plurality of limiting grooves and the clamping block is clamped inside the limiting grooves.

Preferably, an ejector pin is disposed at a corresponding mounting groove on the dumbbell seat, the ejector pin bumping to force the stop to depart from the limiting grooves.

Preferably, two ends of the fixing shaft are provided with cuts, each of the tailstock components further comprises a fixing plate and a tailstock end cover disposed at an outer side of the tailstock rear cover, a middle part of the fixing plate is provided with a pin hole, the pin hole matches with the cuts in shape, and the fixing shaft is limited to be non-rotatable through coordination of the cuts and the pin hole.

Preferably, an inner side of the tailstock inner cover is symmetrically provided with at least two mounting holes, a positioning ejector pin is mounted inside each of the mounting holes, an ejector pin spring is mounted between the positioning ejector pin and a corresponding one of the mounting holes, a plurality of mounting holes are positioned on one same circumference, a positioning hole is provided at a center line position of each of the limiting grooves corresponding to an outer side of each of the limiting grooves and the plurality of the mounting holes and the positioning hole have the same circumferential diameter.

Preferably, two ends at an outer side of the handle tube are imprinted with weight scale around, and the tailstock front cover is imprinted with an indicating groove for alignment of the weight scale to indicate an adjusted weight.

Compared with the prior art, the present invention has the following advantageous effects:

1. With the weight-adjustable dumbbell component with a locking mechanism, by disposing a guiding groove inside a handle tube, a guiding block at one end of one of the sliders is mounted inside the guiding groove, the rotation stopping block at the other end of the sliders is provided inside one of the rotation stopping grooves, and the sliders are non-slidable. When the handle tube rotates, the guiding groove inside the handle tube can pull the one of the sliders to move leftward or rightward. When the sliders move toward a handle direction, the dumbbell pieces can be dismounted due to a width of opening grooves of the dumbbell pieces is greater than an outer diameter of a fixing shaft, when the sliders move remote from the handle direction, the sliders move to the fixing holes of the dumbbell pieces, and the dumbbell pieces are fixed to the dumbbell component due to the width of the opening grooves of the dumbbell pieces is smaller than a diameter of the sliders, so as to finish dismounting or mounting operation of the dumbbell pieces.

2. With the weight-adjustable dumbbell component with a locking mechanism, under effect of the return spring, the stop mounted inside the mounting groove at a lower end of the tailstock inner cover is made to clamp into the limiting grooves of the rotating disk. At this moment, due to synchronously rotatable connection of the rotating disk, the limiting iron plate and the handle tube, the handle thus cannot rotate, so as to prevent the dumbbell pieces falling off when the dumbbell is in use. An ejector pin is disposed on the dumbbell seat. When the dumbbell component is placed into the dumbbell seat, the ejector pin pops the stop up. In this case, the return spring is compressed and the stop falls off the limiting grooves. At this moment, the handle rotates so as to drive the sliders to move to finish mounting or dismounting of the dumbbell pieces. The pin hole in the middle part of the fixing plate is connected with the cuts at two ends of the fixing shaft in a matching manner. When the dumbbell component is placed in the dumbbell seat, the tailstock components are made non-rotatable in a fixing state to prevent the fixing shaft rotating following the rotation of the handle component. The limiting ledge disposed on an outer wall of the tailstock rear cover can prevent the dumbbell pieces slidably falling off leftward and rightward after being mounted. At the same time, it can prevent the dumbbell pieces colliding each other. Weight of the dumbbell pieces decreases from the inside to the outside, thereby obtaining a larger weight-adjustable range. Two ends at an outer side of the handle tube are imprinted with weight scale around, and the tailstock front cover is imprinted with an indicating groove. When the weight scale aligns with the indicating groove, a dumbbell piece of a corresponding weight can be dismounted or mounted accordingly. A counterweight block is disposed inside a fan-shaped mounting cavity disposed at an upper end of the tailstock rear cover to perform the functions of balance and weight increase.

Figure 1:
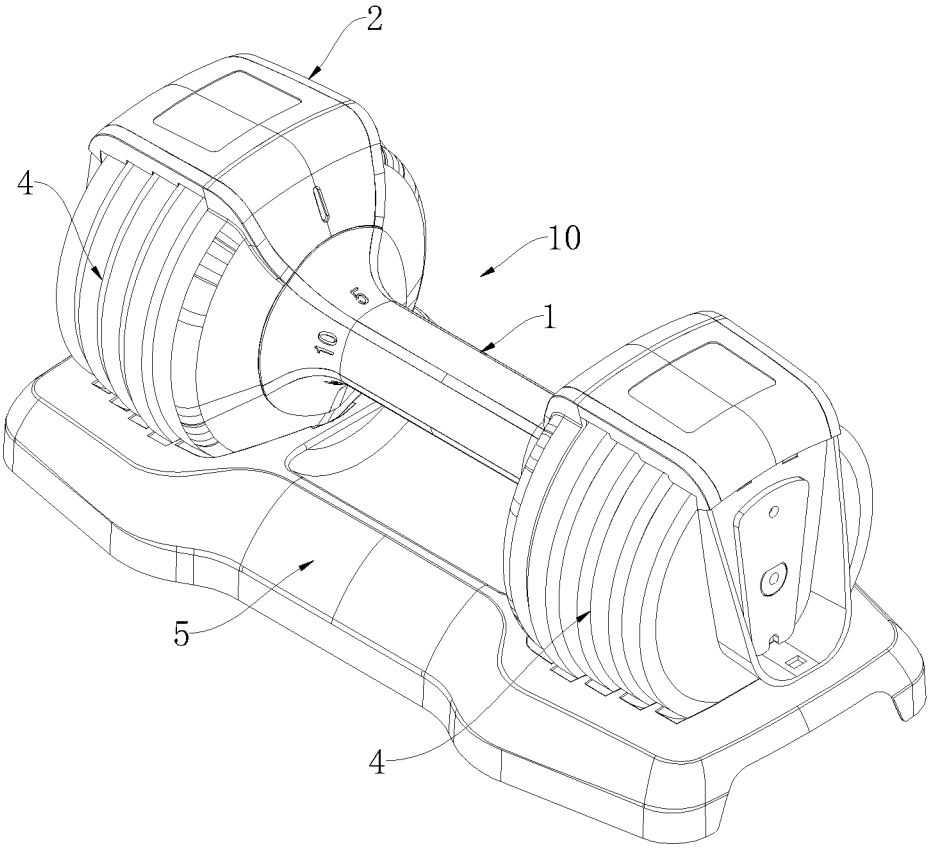
FIG. 1 is a schematic diagram of an overall structure according to embodiment one of the present invention.

In the drawings, 10 means a dumbbell component, 1 a handle component, 101 a handle tube, 1011 a guiding groove, 102 a limiting iron plate, 103 a rotating disk, 1031 a limiting grooves, 10311 a positioning hole, 104 a stop, 1041 a clamping groove, 1042 a placing hole, 1043 a rotary pin, 1044 a bump, 1045 a clamping block, 1046 a recess, 105 a return spring, 2 a tailstock component, 201 a tailstock front cover, 202 a tailstock inner cover, 2021 a mounting groove, 2022 an opening groove, 2023 a fixing groove, 2024 a mounting hole, 203 a tailstock rear cover, 2031 a rotation stopping groove, 2032 a limiting ledge, 2033 a mounting cavity, 204 a tailstock end cover, 205 a fixing plate, 2051 a pin hole, 206 a fixing shaft, 2061 a cut, 207 a counterweight block, 3, a slider, 301 a pipe sleeve, 302 a guiding block, 303 a rotation stopping block, 4 a dumbbell piece, 401 a fixing hole, 402 an opening groove, 5 a dumbbell seat, 51 an ejector pin, 601 a positioning ejector pin and 602 an ejector pin spring.

DESCRIPTION OF EMBODIMENTS

Accompanying drawings in embodiments of the present invention will be incorporated below to describe the technical solution in embodiments of the present invention clearly and completely. Obviously, the embodiments described are merely a part of embodiments of the present invention rather than all embodiments. Based on embodiments of the present invention, all other embodiments obtained by those skilled in the art under the precondition of not paying creative labor should belong to the protection scope of the present invention.

Embodiment One

Figure 5:
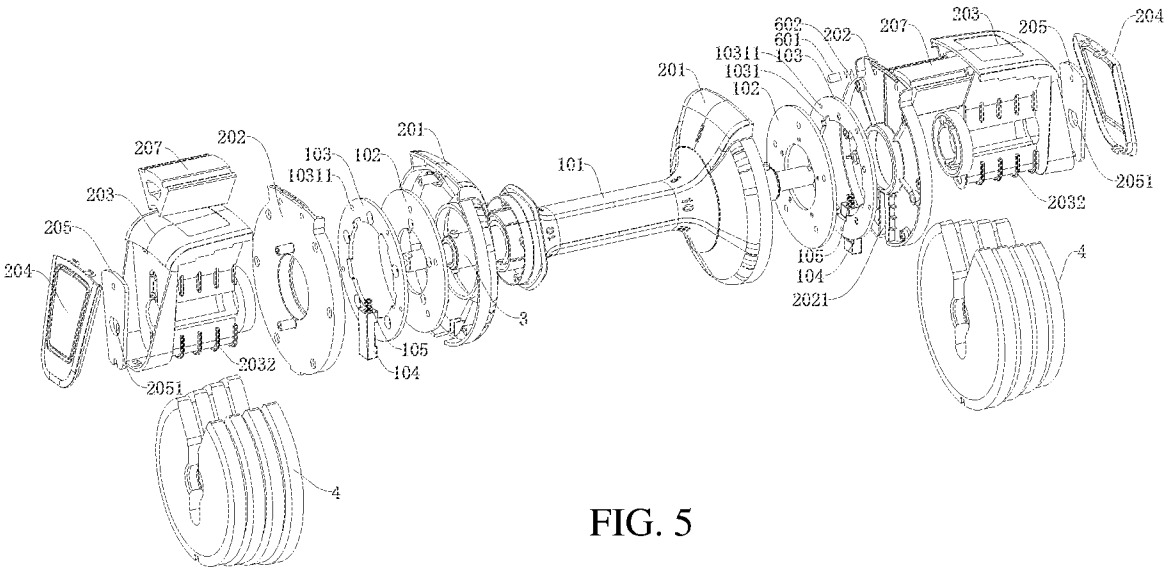
FIG. 5 is a schematic diagram of an overall explosion structure according to embodiment one of the present invention.
Figure 6:
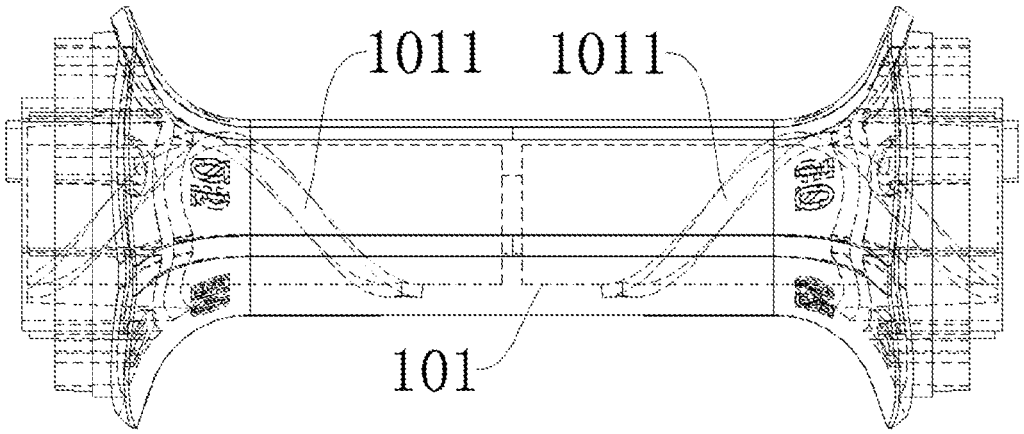
FIG. 6 is a schematic diagram of a handle tube's perspective structure according to embodiment one of the present invention.
Figure 7:
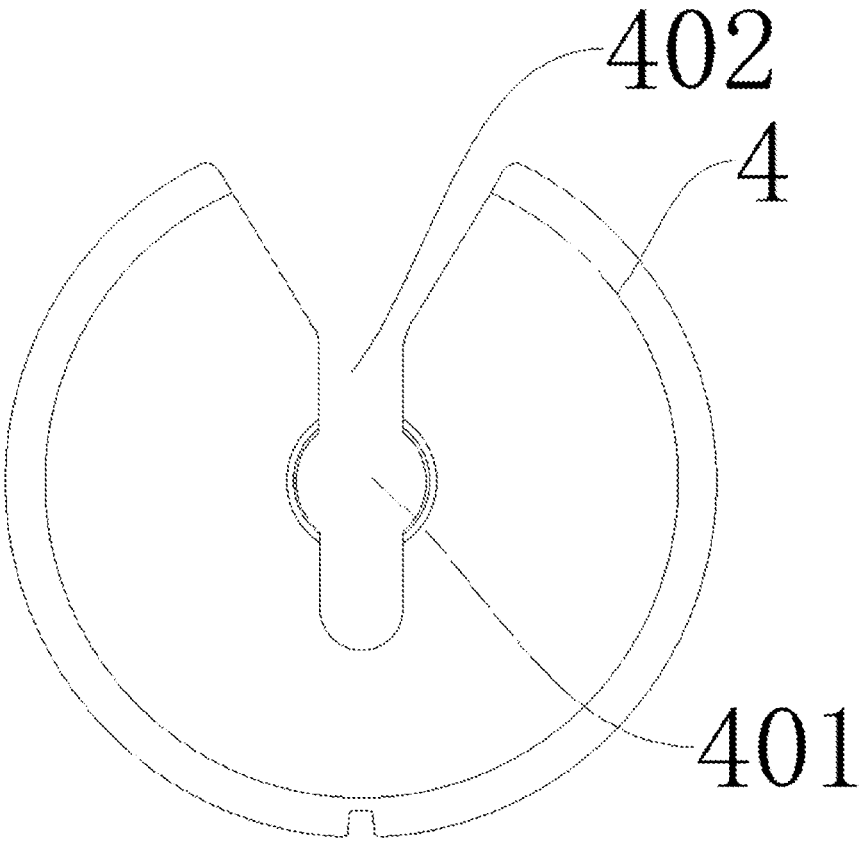
FIG. 7 is a schematic diagram of a dumbbell piece's structure according to embodiment one of the present invention.
Figure 8:
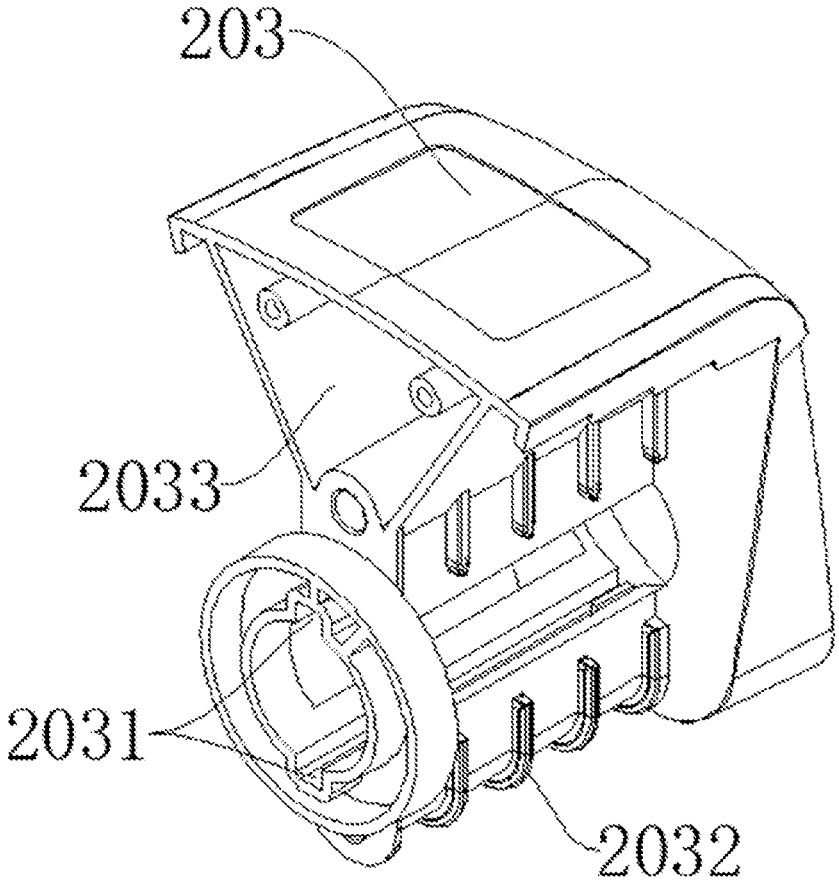
FIG. 8 is a schematic diagram of a tailstock rear cover's structure according to embodiment one of the present invention.
Figure 9:
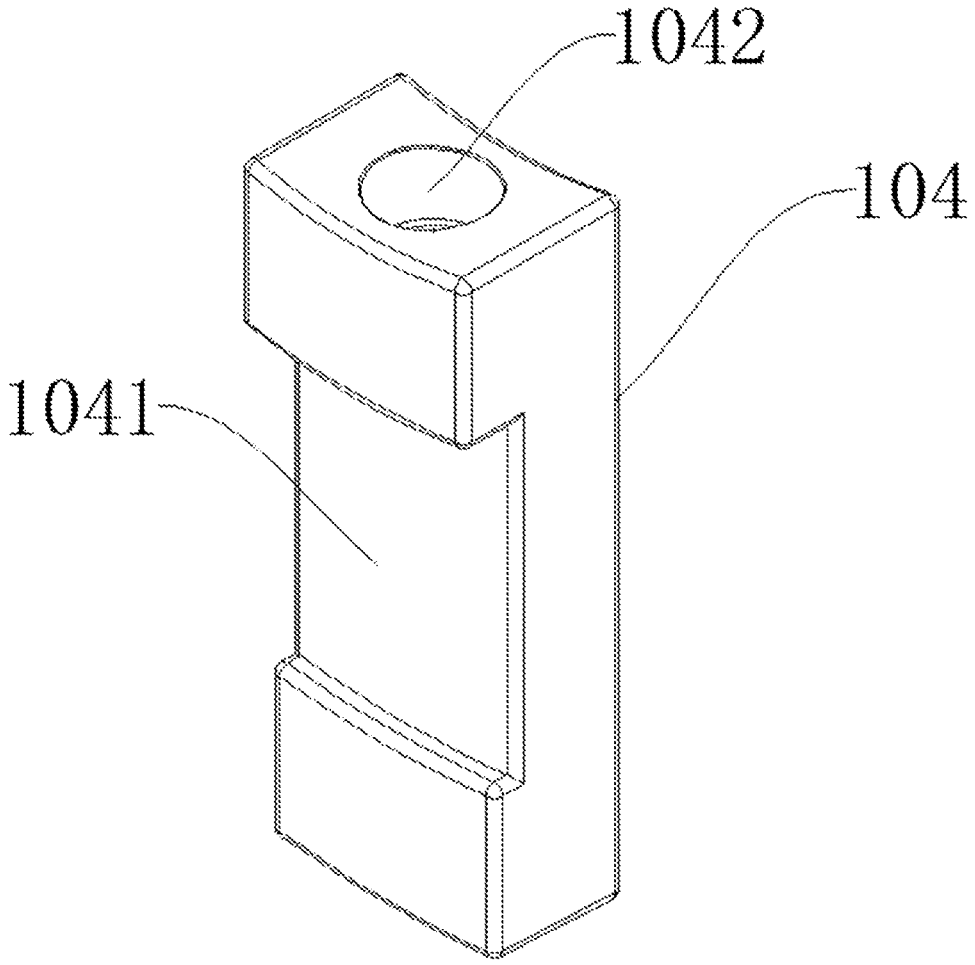
FIG. 9 is a schematic diagram of a stop's structure according to embodiment one of the present invention.
Figure 10:
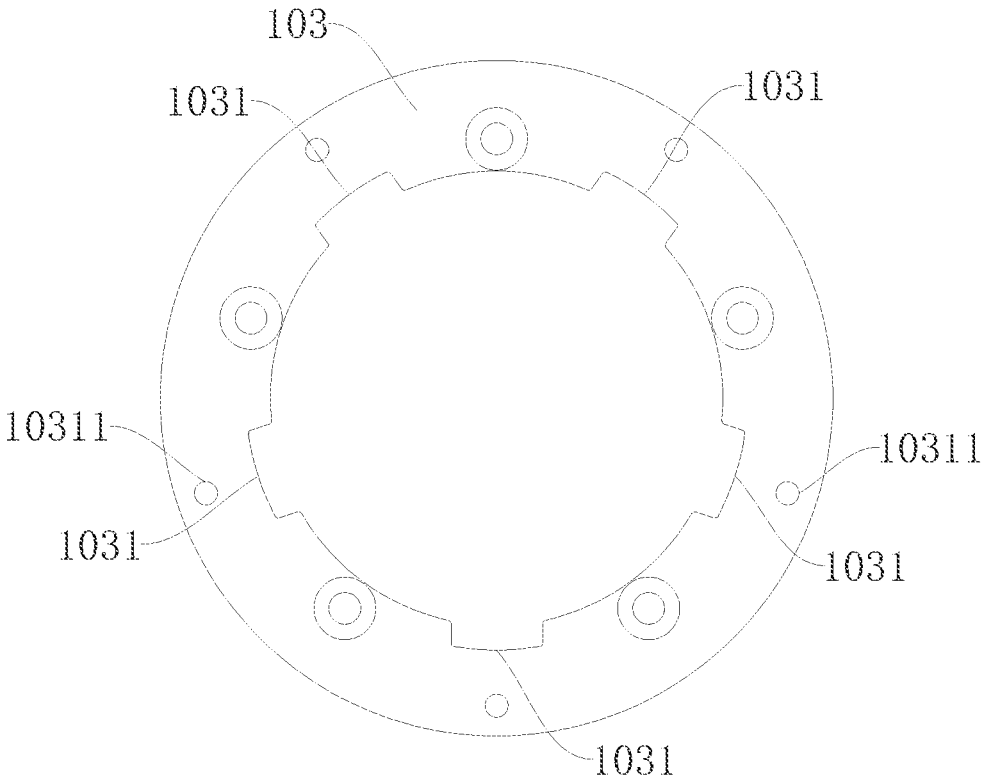
FIG. 10 is a schematic diagram of a rotating disk's structure according to embodiment one of the present invention.
Figure 11:
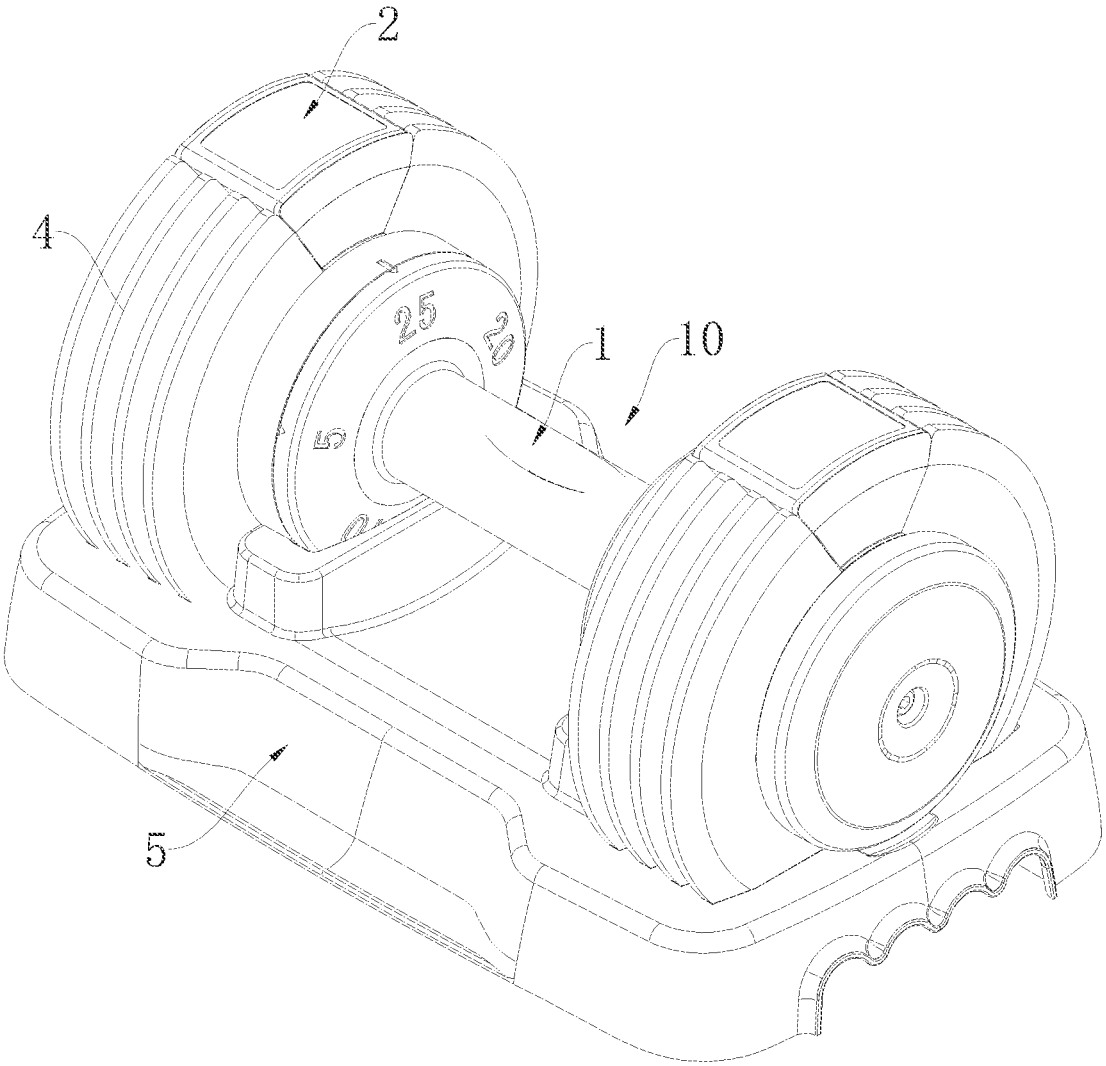
FIG. 11 is a schematic diagram of an overall structure according to embodiment two of the present invention.
Figure 12:
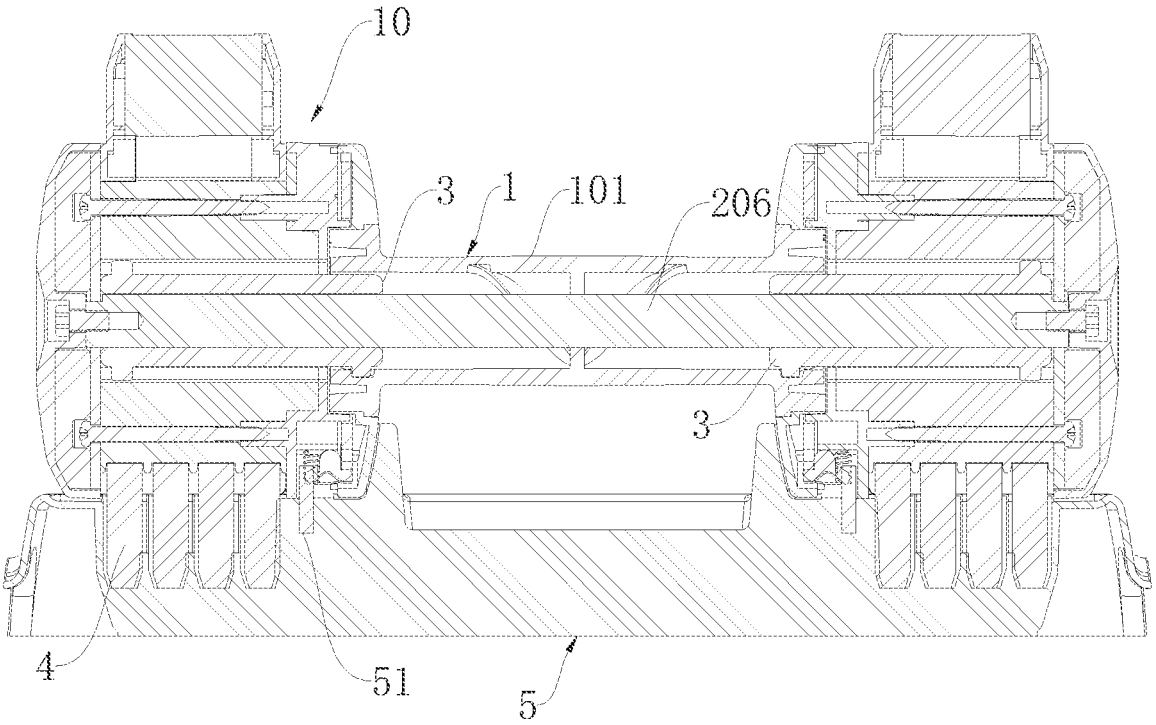
FIG. 12 is a schematic diagram of an overall section structure according to embodiment two of the present invention.

Please referring to FIGS. 1-10, the present invention provides a technical solution as follows: a weight-adjustable dumbbell component with a locking mechanism, comprising a dumbbell component 10, a dumbbell seat 5 and a plurality of dumbbell pieces 4 placed at two sides of the dumbbell seat 5, wherein the dumbbell component 10 comprises a handle component 1, tailstock components 2 disposed at two sides of the handle component 1 and two sliders 3 movably connected to two ends of the handle component 1, the handle component 1 is rotatably connected between two tailstock components 2, the handle component 1 comprises a handle tube 101, wherein the handle tube 101 is a hollow tube and as shown in FIG. 6, two guiding grooves 1011 with opposite bolt directions are disposed at an inner wall of the handle tube 101, each of the sliders 3 comprises a pipe sleeve 301, wherein one end of the pipe sleeve 301 close to the handle component 1 is provided with a guiding block 302 and the other end thereof is provided with a rotation stopping block 303, the tailstock components 2 are provided with rotation stopping grooves 2031 thereon, the guiding block 302 is slidably mounted inside one of the guiding grooves 2031, the rotation stopping block 303 is mounted inside one of the rotation stopping grooves 2031, rotating the handle component 1 can drive the sliders 3 to move slidably inside the rotation stopping grooves 2031, each of the tailstock component 2 comprises a tailstock rear cover 203 provided with the rotation stopping grooves 2031 and a fixing shaft 206 disposed inside the handle tube 101 in a penetrating manner, middle parts of the dumbbell pieces 4 are provided with fixing holes 401 for insertion of the sliders 3, upper ends of the fixing holes 401 are provided with opening grooves 402 communicating therewith, a width of the opening grooves 402 is smaller than a diameter of the sliders 3, and the width of the opening grooves 402 is greater than a diameter of the fixing shaft 206. By disposing a guiding groove inside a handle tube, a guiding block at one end of one of the sliders is mounted inside the guiding groove, the rotation stopping block at the other end of the one of the sliders is provided inside one of the rotation stopping grooves, and the sliders are non-slidable. When the handle tube rotates, the guiding groove inside the handle tube can pull the one of the sliders to move leftward or rightward. When the sliders move toward a handle direction, the dumbbell pieces can be dismounted due to a width of opening grooves of the dumbbell pieces is greater than an outer diameter of a fixing shaft, when the sliders move remote from the handle direction, the sliders move to the fixing holes of the dumbbell pieces, and the dumbbell pieces are fixed to the dumbbell component due to the width of the opening grooves of the dumbbell pieces is smaller than a diameter of the sliders, so as to finish dismounting or mounting operation of the dumbbell pieces.

As shown in FIG. 5, the handle component 1 comprises a limiting iron plate 102 capable of rotating synchronously with the handle tube 101, the limiting iron plate 102 is bolt-connected to the handle tube 101, an outer side of the limiting iron plate 102 is fixedly connected with a rotating disk 103, the rotating disk is of a round shape and is provided with a plurality of limiting grooves 1031 thereon, each of the tailstock components 2 comprises a tailstock front cover 201 and a tailstock inner cover 202, the limiting iron plate 102 and the rotating disk 103 are disposed between the tailstock front cover 201 and the tailstock inner cover 202, a lower end of the tailstock inner cover 202 is slidably connected with a stop 104, the stop 104 can be clamped in the limiting grooves 1031 to limit rotation of the handle component 1 relative to one of the tailstock components 2.

A lower end of the tailstock inner cover 202 is provided with a mounting groove 2021, the stop 104 is movably mounted inside the mounting groove 2021, and a return spring 105 is mounted between the stop 104 and the mounting groove 2021, the return spring 105 forcing the stop 104 to press in the limiting grooves 10031. A middle part of the stop 104 is provided with a clamping groove 1041, a top end of the stop 104 is provided with a placing hole 1042, upper and lower end surfaces of the stop 104 and upper and lower end surfaces of the clamping groove 1041 all have a shape of circular arc, an inner circular ring of the rotating disk 103 is provided with a plurality of limiting grooves 1031, the rotating disk 103 is disposed inside the clamping groove 1041, one end of the return spring 105 is mounted inside the placing hole 1042 and the other end of the return spring 105 abuts against a top end of the mounting groove 2021. Under effect of the return spring, the stop mounted inside the mounting groove at a lower end of the tailstock inner cover is made to clamp into the limiting groove of the rotating disk. At this moment, due to synchronously rotatable connection of the rotating disk, the limiting iron plate and the handle tube, the handle thus cannot rotate, so as to prevent the dumbbell pieces falling off when the dumbbell is in use.

Figure 2:
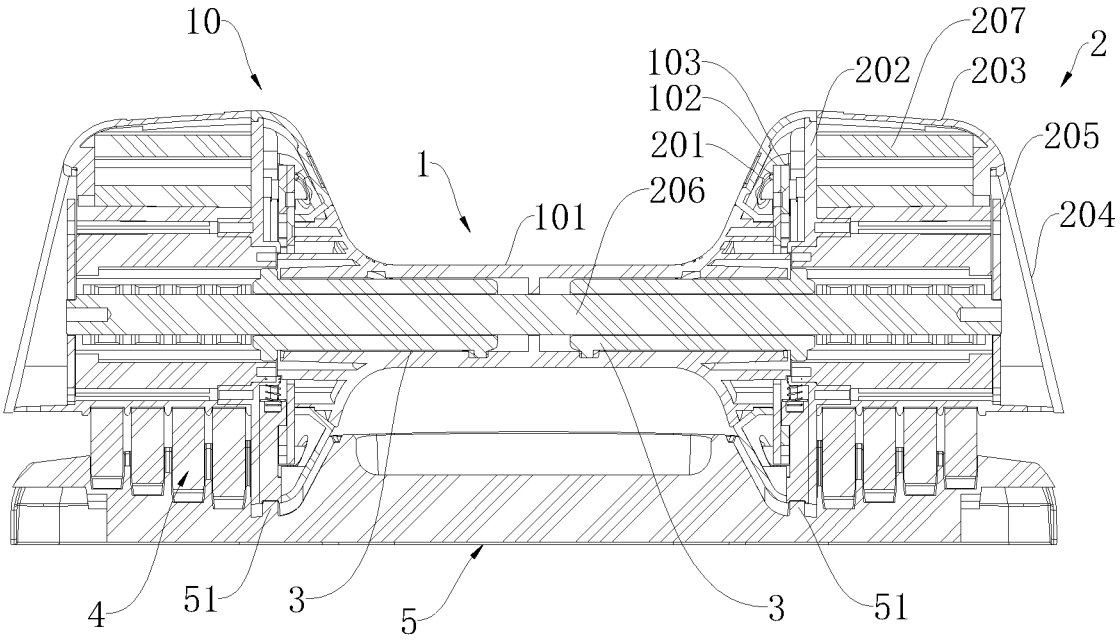
FIG. 2 is a schematic diagram of an overall section structure according to embodiment one of the present invention.
Figure 3:
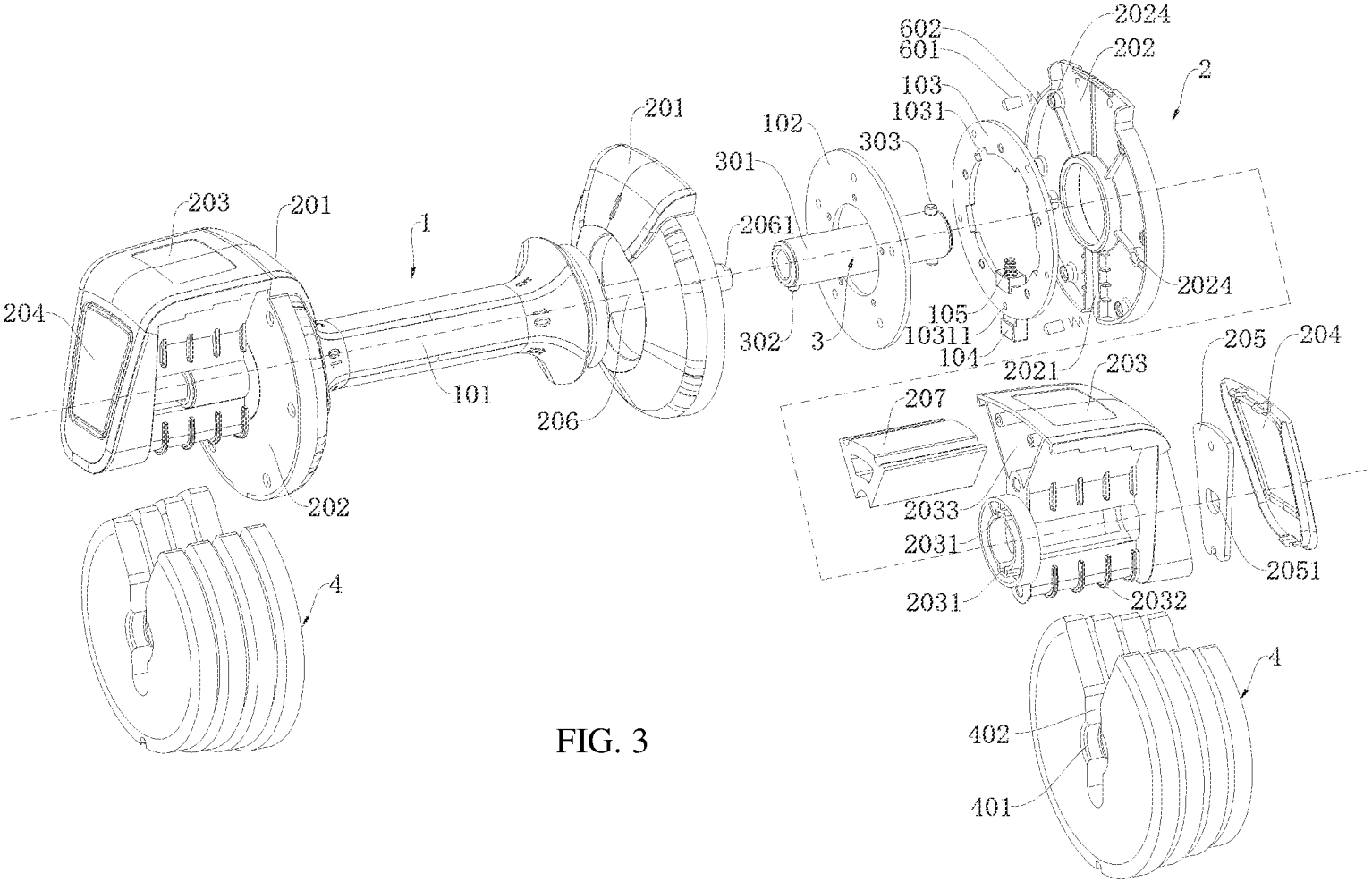
FIG. 3 is a schematic diagram of a local explosion structure according to embodiment one of the present invention.
Figure 4:
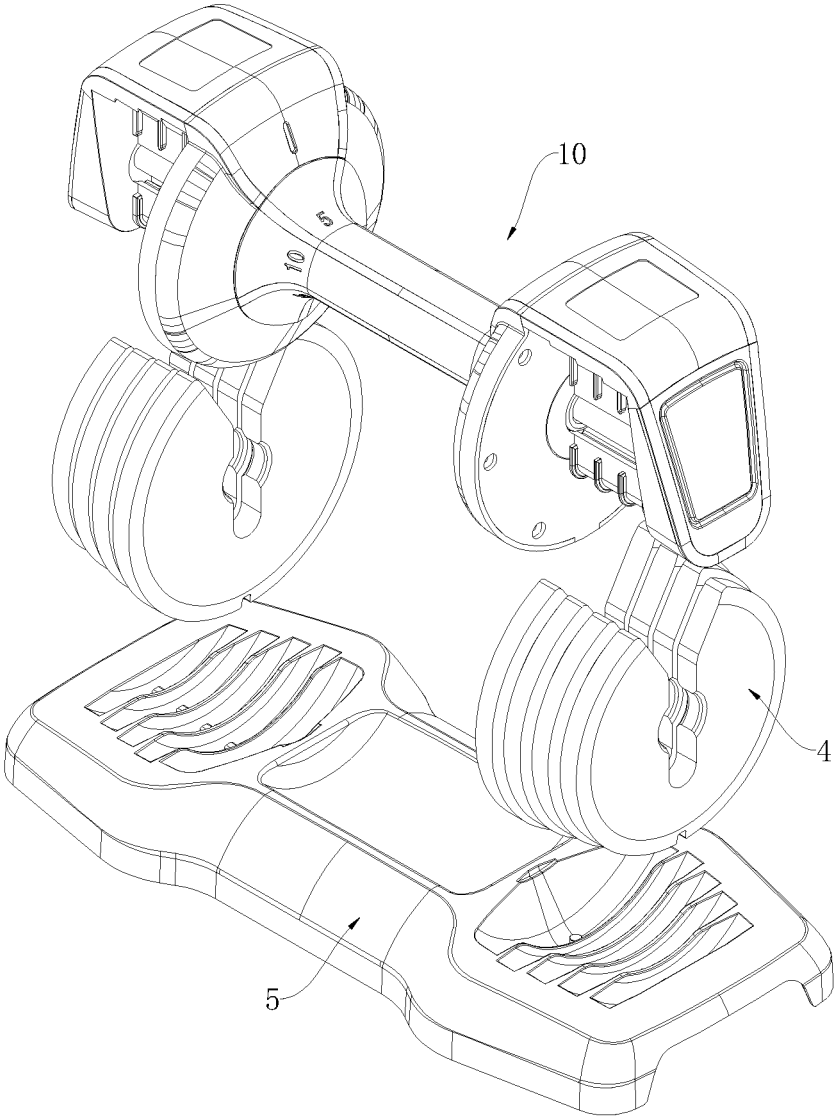
FIG. 4 is a schematic diagram of a split structure according to embodiment one of the present invention.

As shown in FIG. 2, an ejector pin 51 is disposed at a corresponding mounting groove 2021 on the dumbbell seat 5, the ejector pin 51 bumping to force the stop 104 to depart from the limiting grooves 1031.

Two ends of the fixing shaft 206 are provided with cuts 2061, each of the tailstock components 2 further comprises a fixing plate 205 and a tailstock end cover 204 disposed at an outer side of the tailstock rear cover 203, a middle part of the fixing plate 205 is provided with a pin hole 2051, the pin hole 2051 matches with the cuts 2061 in shape, and the fixing shaft 206 is limited to be non-rotatable through coordination of the cuts 2061 and the pin hole 2051. The pin hole in the middle part of the fixing plate is connected with the cuts at two ends of the fixing shafts in a matching manner. When the dumbbell component is placed in the dumbbell seat, the tailstock components are made non-rotatable in a fixing state to prevent the fixing shaft rotating following the rotation of the handle component.

An inner side of the tailstock inner cover 202 is symmetrically provided with at least two mounting holes 2024, a positioning ejector pin 601 is mounted inside one of the mounting holes 2024, an ejector pin spring 602 is mounted between the positioning ejector pin 601 and the mounting holes 2024, a plurality of mounting holes 2024 are positioned on one same circumference, a positioning hole 10311 is provided at a center line position of one of the limiting grooves 1031 corresponding to an outer side of each of the limiting grooves 1031 and the plurality of the mounting holes 2024 and the positioning hole 10311 have the same circumferential diameter. Under the effect of the ejector pin spring, the positioning ejector pin abuts against the rotating disk. Moreover, when the rotating disk rotates, a spherical shape on the top of the positioning ejector pin can partially fall into the positioning hole to enable an operator to form a damper feeling upon rotation. However, since a radius of the spherical shape is far bigger than a diameter of the positioning hole, thus it prevents the positioning ejector pin sticking a limiting disk. Thus when a locking block departs from a locking groove, through the damper feeling, a user can determine whether the locking groove has been aligned with the locking block or not so as to prevent failed locking of the locking block.

Two ends at an outer side of the handle tube 101 are imprinted with weight scale around, and the tailstock front cover 201 is imprinted with an indicating groove for alignment of the weight scale to indicate an adjusted weight. Two ends at an outer side of the handle tube are imprinted with weight scale around, and the tailstock front cover is imprinted with an indicating groove. When the weight scale aligns with the indicating groove, a dumbbell piece of a corresponding weight can be dismounted or mounted accordingly.

Embodiment Two

Please referring to FIGS. 11-20, the present invention provides a technical solution as follows: a weight-adjustable dumbbell component with a locking mechanism, comprising a dumbbell component 10, a dumbbell seat 5 and a plurality of dumbbell pieces 4 placed at two sides of the dumbbell seat 5, wherein the dumbbell component 10 comprises a handle component 1, tailstock components 2 disposed at two sides of the handle component 1 and two sliders 3 movably connected to two ends of the handle component 1, the handle component 1 is rotatably connected between two tailstock components 2, the handle component 1 comprises a handle tube 101, wherein the handle tube 101 is a hollow tube and two guiding grooves 1011 with opposite bolt directions are disposed at an inner wall of the handle component 101, each of the sliders 3 comprises a pipe sleeve 301, wherein one end of the pipe sleeve 301 close to the handle component 1 is provided with a guiding block 302 and the other end thereof is provided with a rotation stopping block 303, the tailstock components 2 are provided with rotation stopping grooves 2031 thereon, the guiding block 302 is slidably mounted inside one of the guiding grooves 1011, the rotation stopping block 303 is mounted inside one of the rotation stopping grooves 2031, rotating the handle component 1 can drive the sliders 3 to move slidably inside one of the rotation stopping grooves 2031, each of the tailstock component 2 comprises a tailstock rear cover 203 provided with the rotation stopping grooves 2031 and a fixing shaft 206 disposed inside the handle tube 101 in a penetrating manner, middle parts of the dumbbell pieces 4 are provided with fixing holes 401 for insertion of the sliders 3, upper ends of the fixing holes 401 are provided with opening grooves 402 communicating therewith, a width of the opening grooves 402 is smaller than a diameter of the sliders 3, and the width of the opening grooves 402 is greater than a diameter of the fixing shaft 206.

The handle component 1 comprises a rotating disk 103 capable of rotating synchronously with the handle tube 101, the rotating disk is of a round shape and is provided with a plurality of limiting grooves 1031 thereon, each of the tailstock components 2 comprises a tailstock front cover 201 and a tailstock inner cover 202, the rotating disk 103 is disposed between the tailstock front cover 201 and the tailstock inner cover 202, and a lower end of the tailstock inner cover 202 is provided with a stop 104, the stop 104 can be clamped into the limiting grooves 1031 to limit rotation of the handle component 1 relative to one of the tailstock components 2.

A lower end of the tailstock inner cover 202 is provided with a mounting groove 2021, the stop 104 is movably mounted inside the mounting groove 2021, and a return spring 105 is mounted between the stop 104 and the mounting groove 2021, the return spring 105 forcing the stop 104 to press in the limiting grooves 1031.

Figure 16:
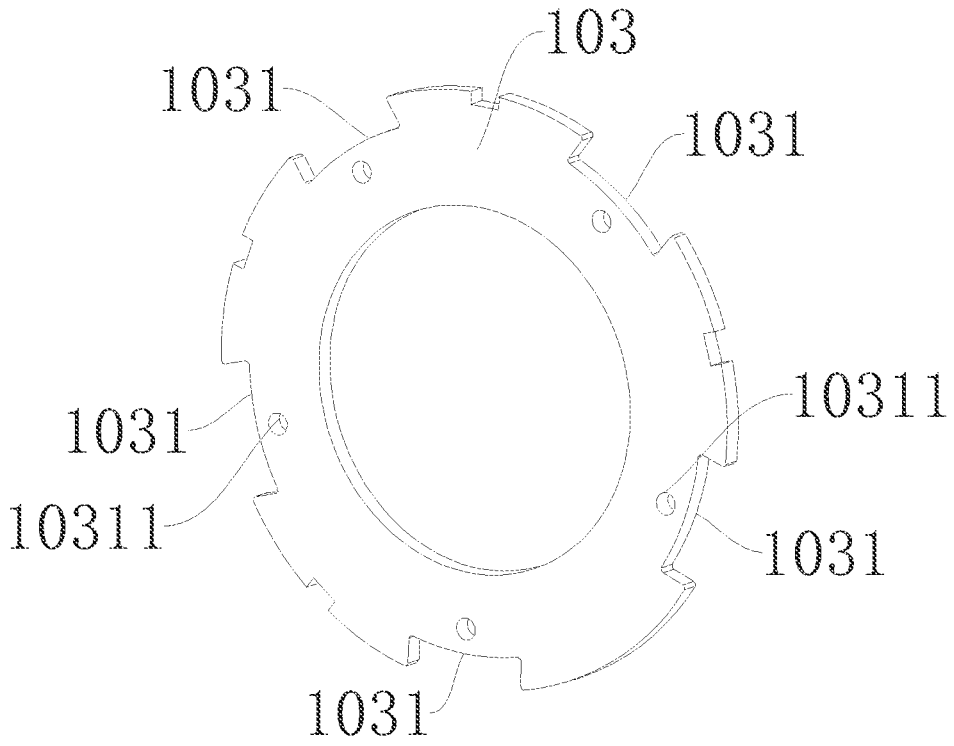
FIG. 16 is a schematic diagram of a rotating disk's structure according to embodiment two of the present invention.
Figure 20:
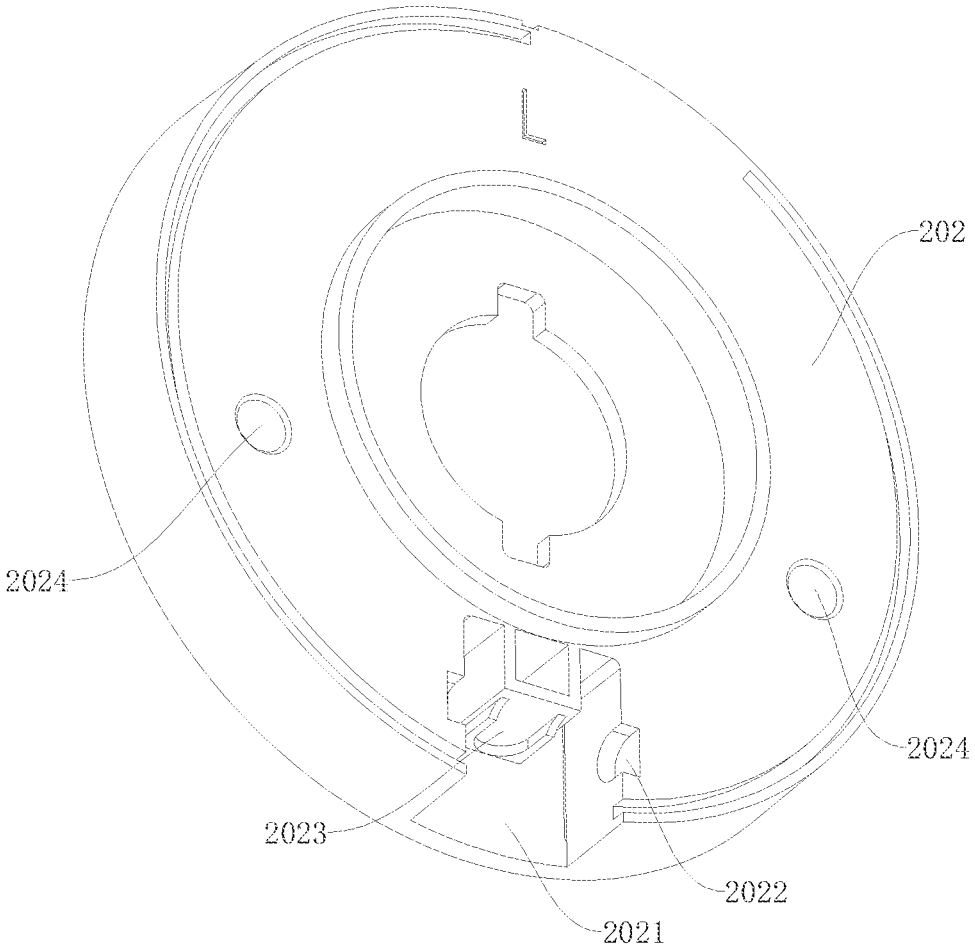
FIG. 20 is a schematic diagram of a tailstock inner cover's structure according to embodiment two of the present invention.
Figure 21:
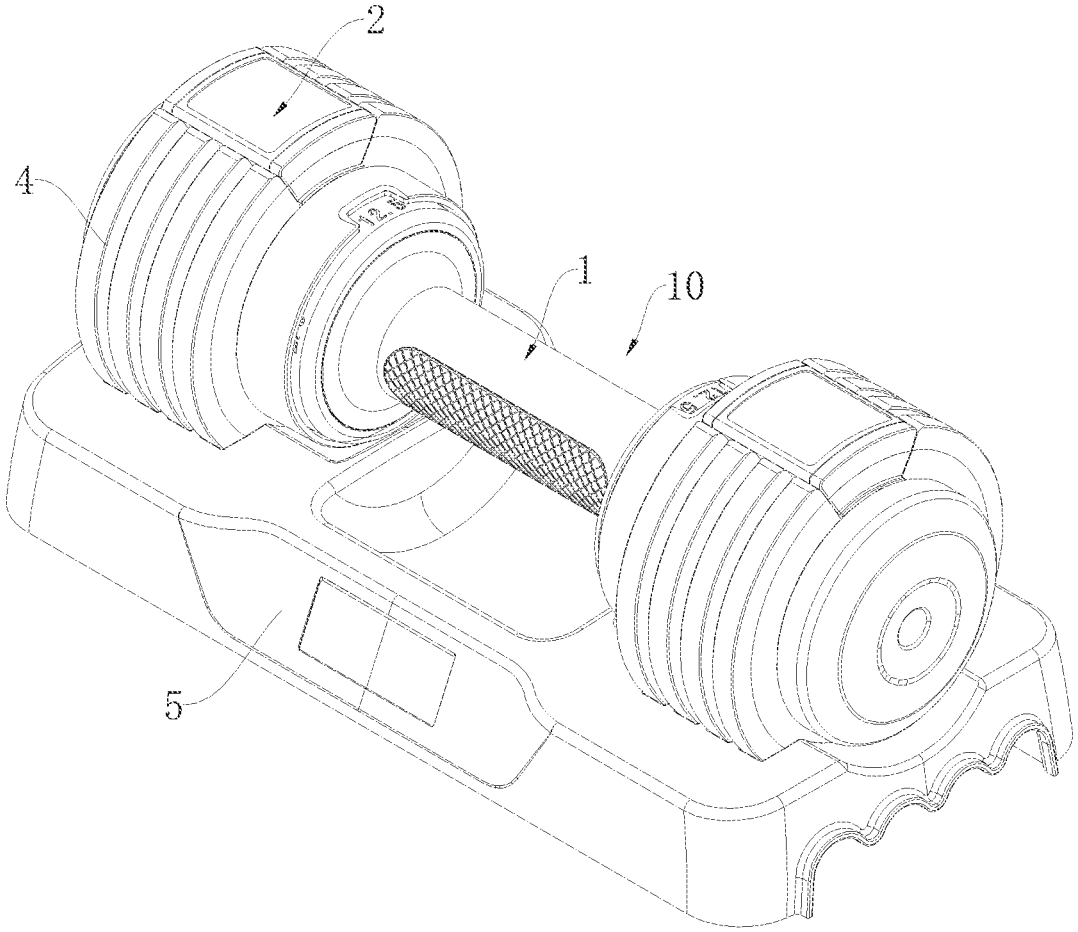
FIG. 21 is a schematic diagram of an overall structure according to embodiment three of the present invention.
Figure 22:
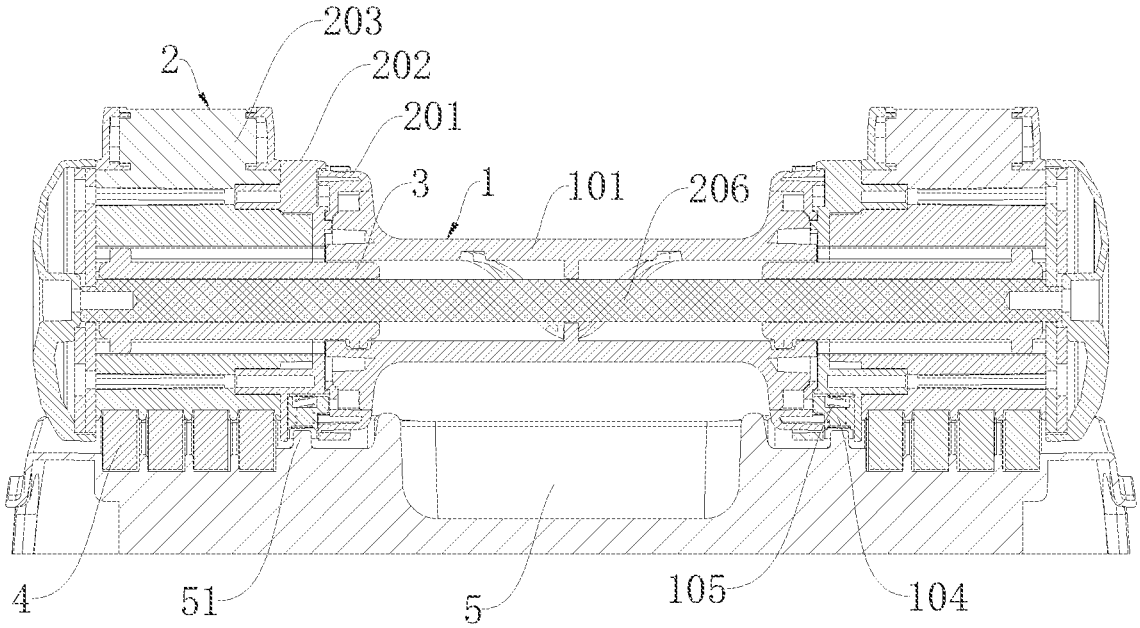
FIG. 22 is a schematic diagram of an overall section structure according to embodiment three of the present invention.
Figure 23:
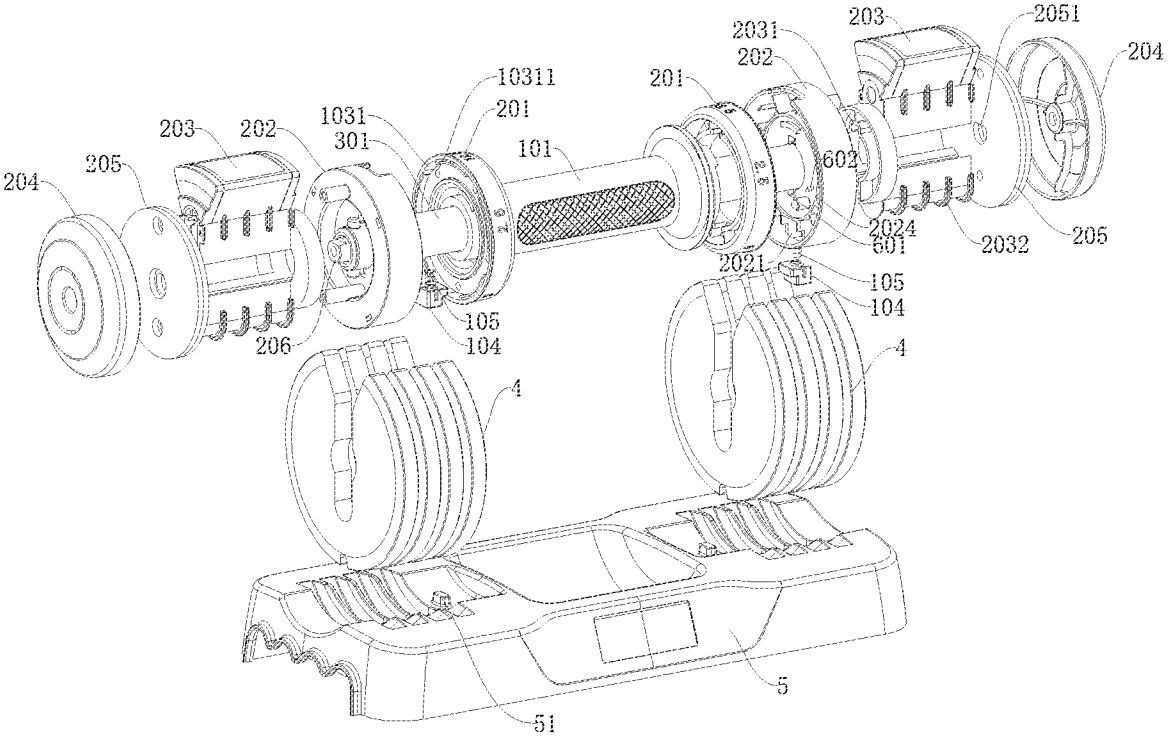
FIG. 23 is a schematic diagram of a local explosion structure according to embodiment three of the present invention.
Figure 24:
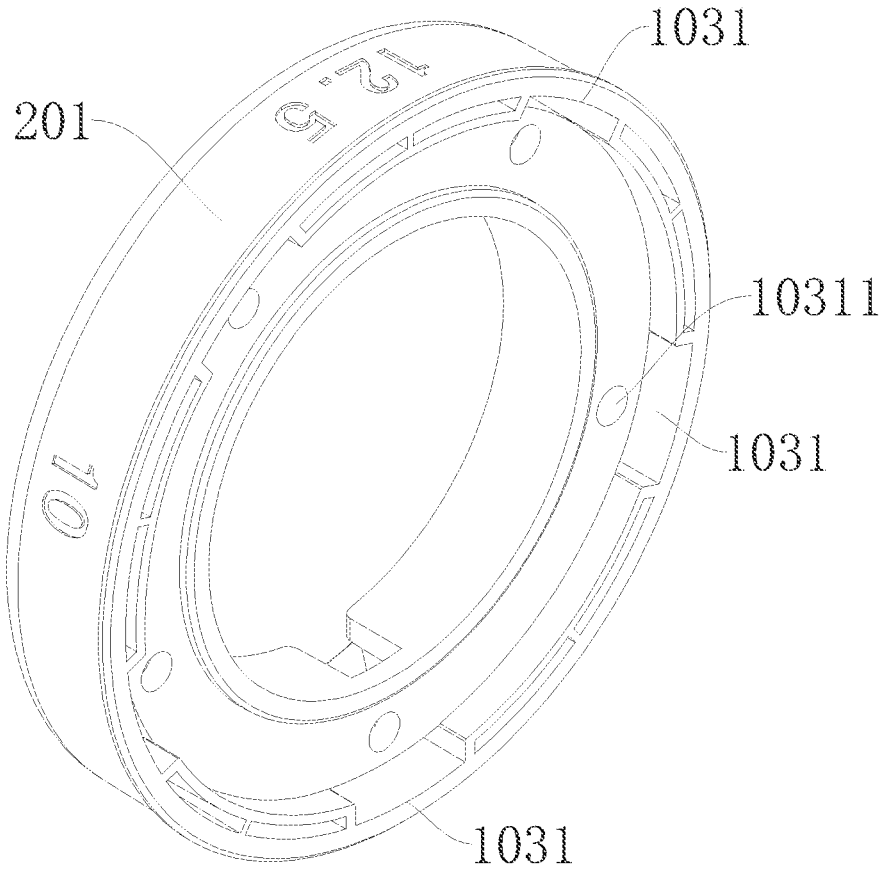
FIG. 24 is a schematic diagram of a tailstock front cover's structure according to embodiment three of the present invention.
Figure 25:
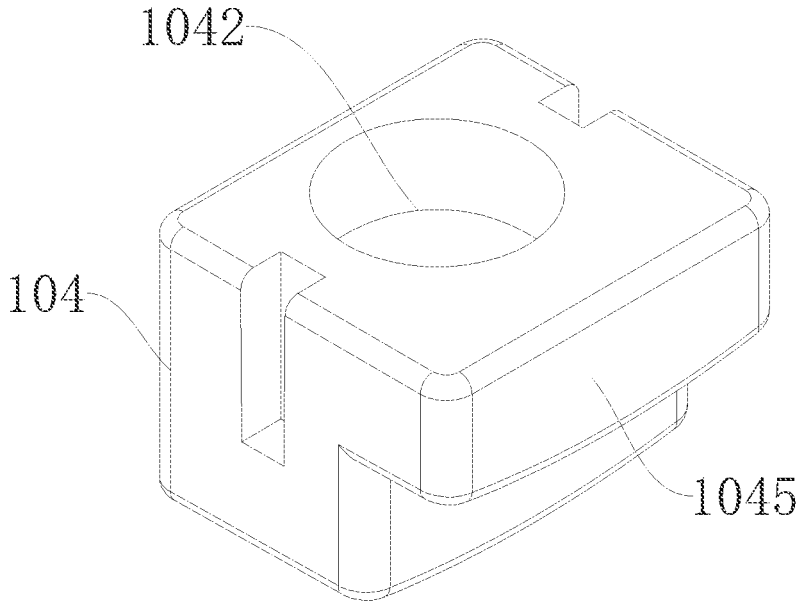
FIG. 25 is a schematic diagram of a stop's structure according to embodiment three of the present invention.
Figure 26:
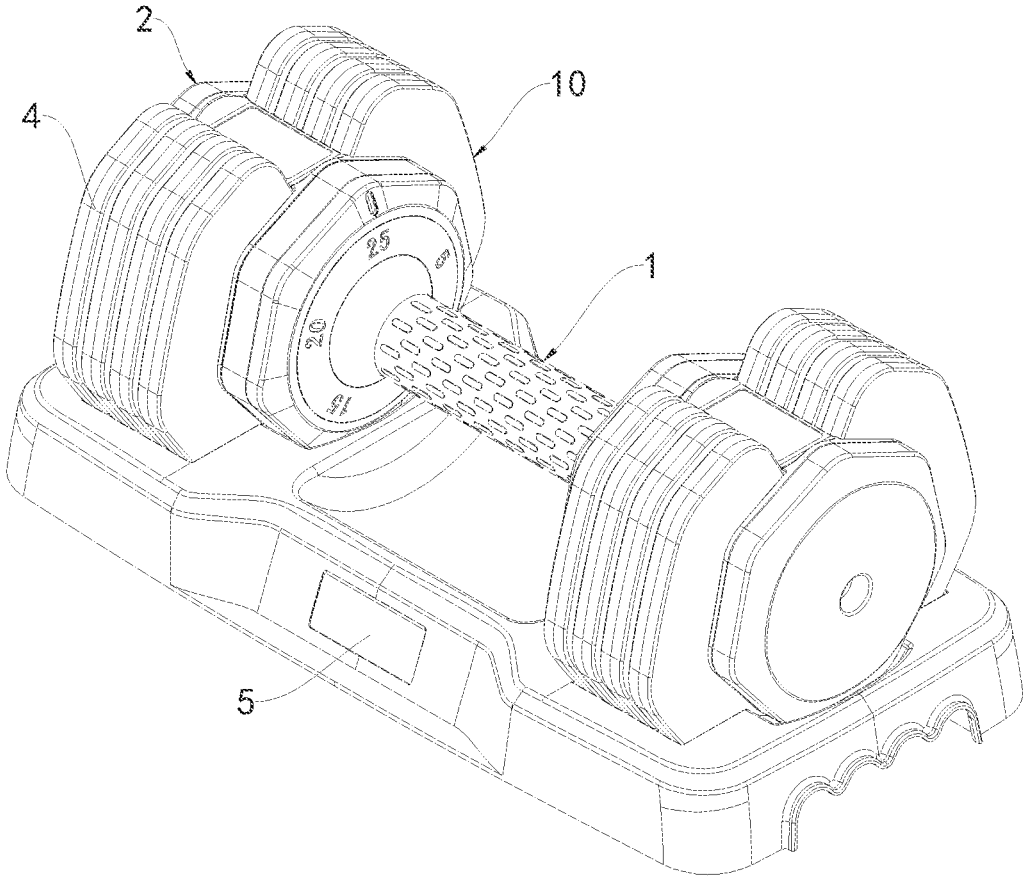
FIG. 26 is a schematic diagram of another overall structure according to embodiment three of the present invention.
Figure 27:
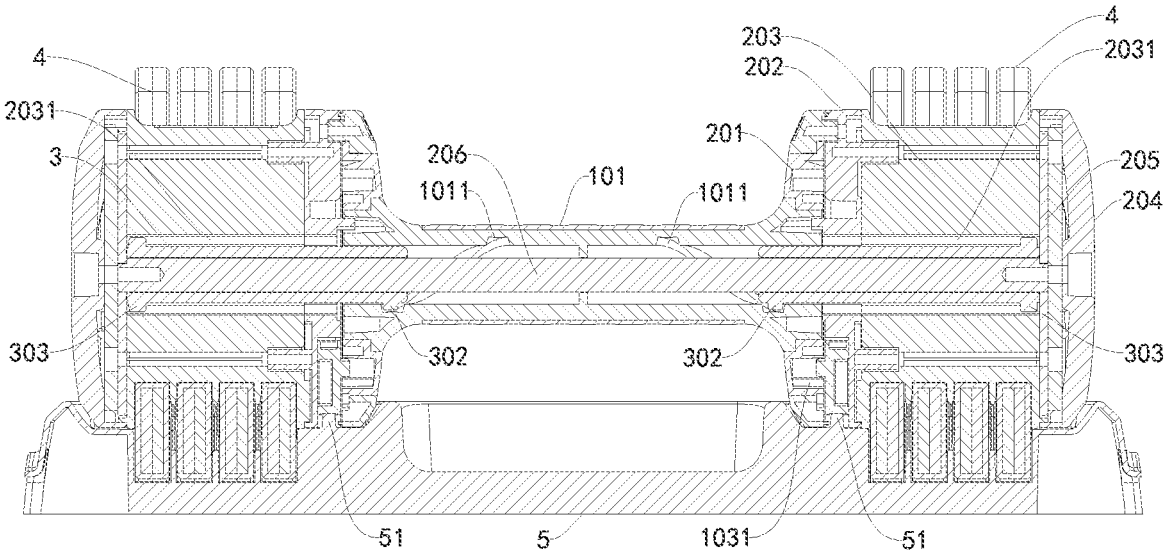
FIG. 27 is a schematic diagram of another overall section according to embodiment three of the present invention.
Figure 28:
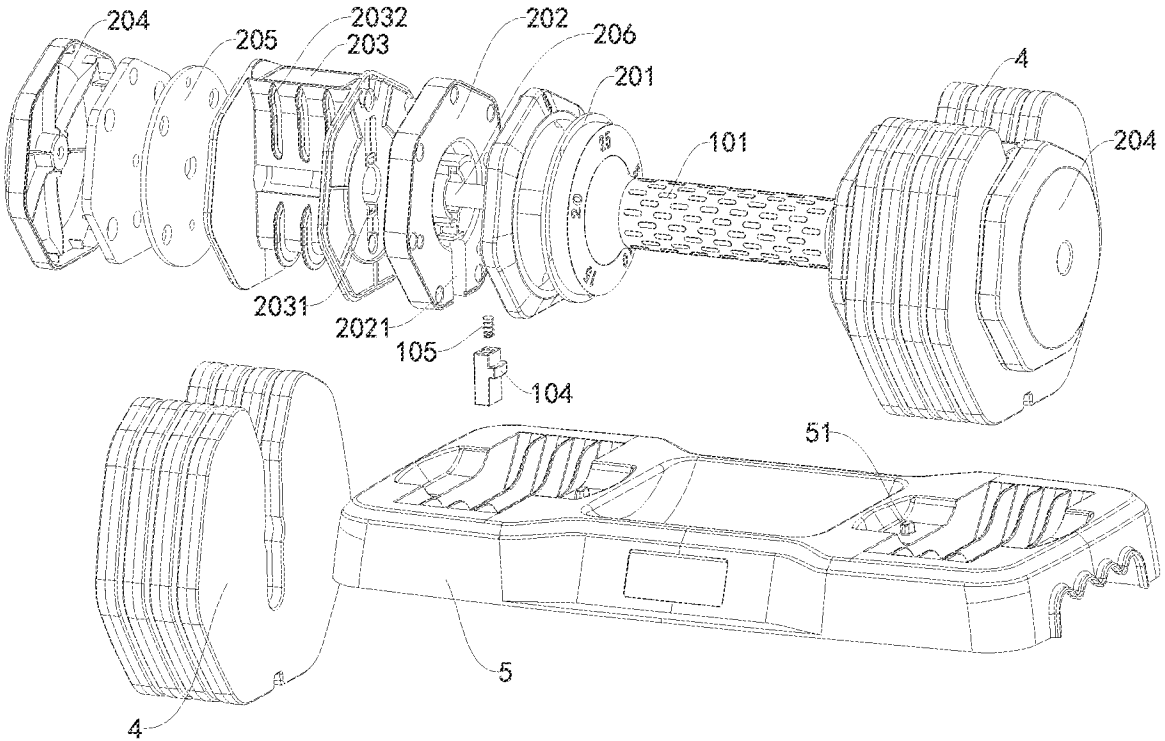
FIG. 28 is a schematic diagram of another explosion structure according to embodiment three of the present invention.
Figure 29:
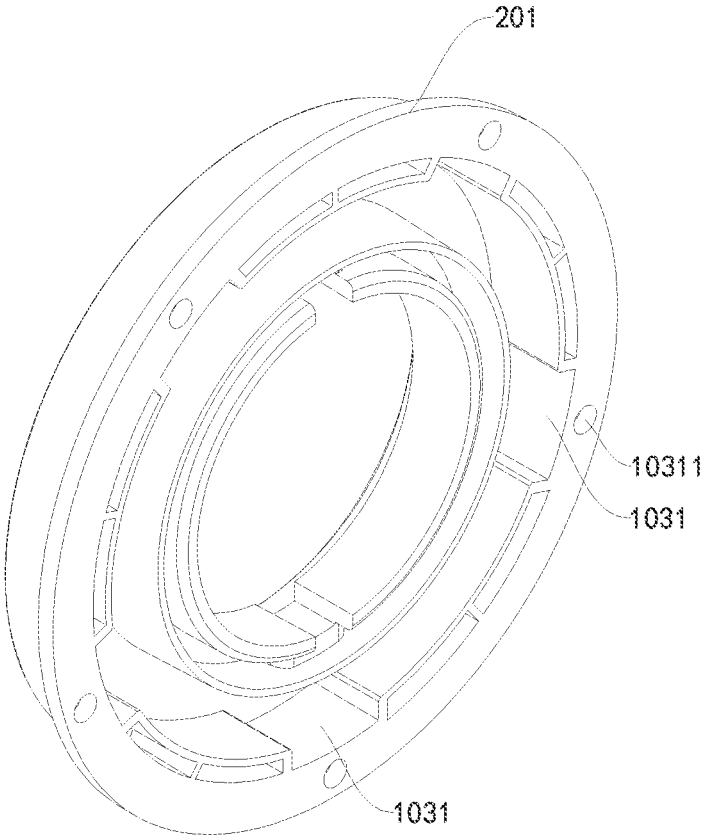
FIG. 29 is a schematic diagram of another tailstock front cover's structure according to embodiment three of the present invention.
Figure 30:
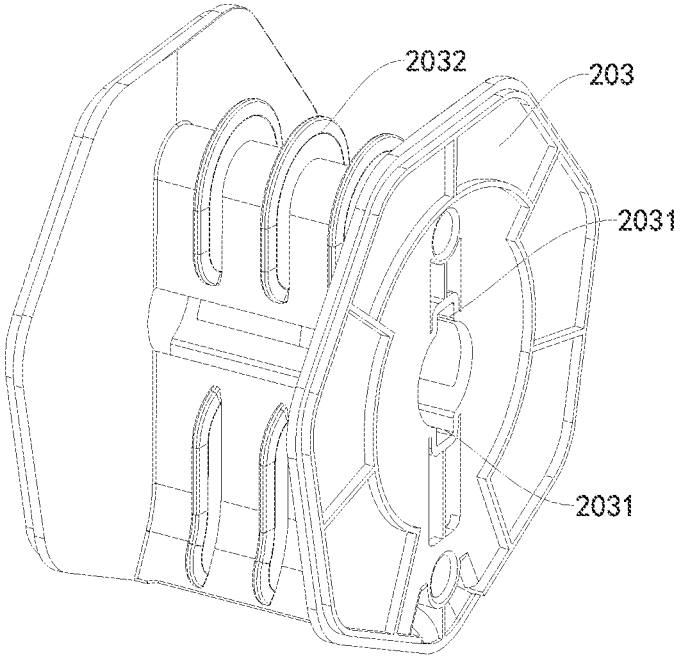
FIG. 30 is a schematic diagram of another tailstock rear cover's structure according to embodiment three of the present invention.
Figure 31:
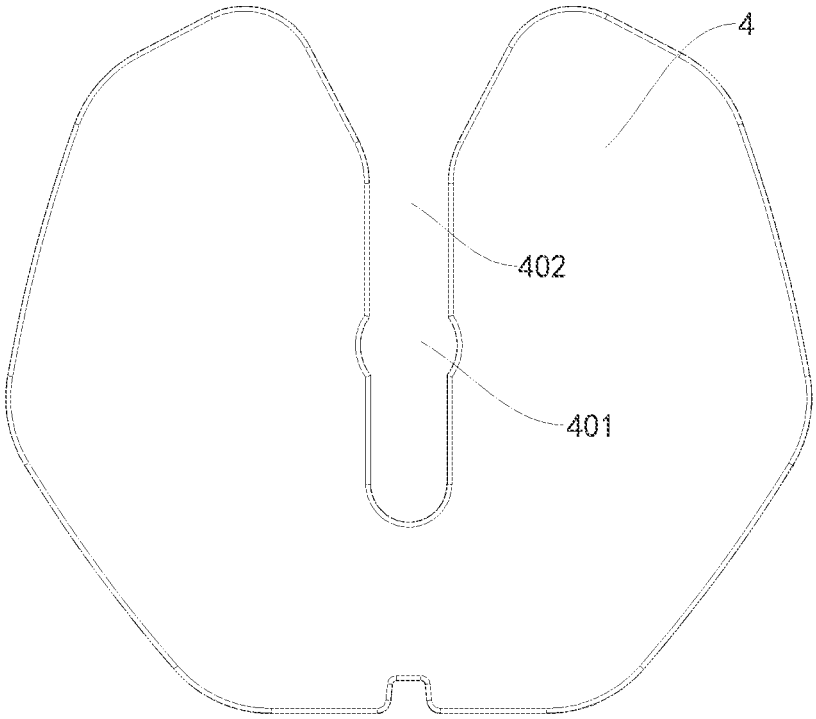
FIG. 31 is a schematic diagram of another dumbbell piece's structure according to embodiment three of the present invention.
Figure 32:
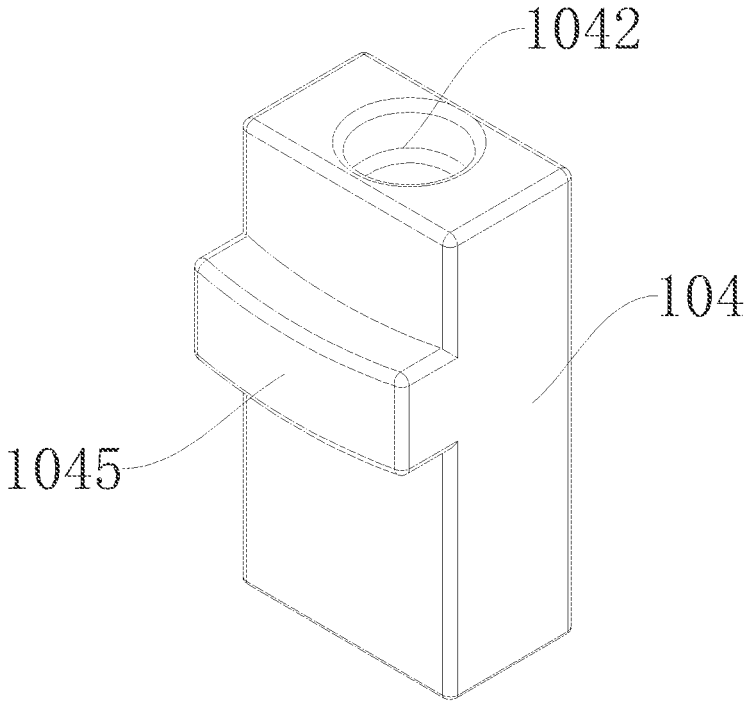
FIG. 32 is a schematic diagram of another stop's structure according to embodiment three of the present invention.

As shown in FIG. 20, an inner side surface of the mounting groove 2021 is provided with an opening groove 2022, an upper end surface of the mounting groove 2021 is provided with a fixing groove 2023, a locking mechanism is mounted inside the mounting groove 2021, the locking mechanism comprises a return spring 105 and a stop 104, two ends of the stop 104 are provided with rotary pins 1043, a front side of the stop 104 is provided with a bump 1044, a rear side of the stop 104 is provided with a clamping block 1045, a lower end surface of the stop 104 is provided with a recess 1046, the stop 104 is rotatably mounted inside the opening groove 2022 through the rotary pins 1043, an upper end of the return spring 105 is mounted inside the fixing groove 2023, and a lower end of the return spring is fixed on the bump 1044. As shown in FIG. 16, an outer circular ring of the rotating disk 103 is provided with a plurality of limiting grooves 1031 and the clamping block 1045 is clamped inside the limiting grooves 1031.

An ejector pin 51 is disposed at a corresponding mounting groove 2021 on the dumbbell seat 5, the ejector pin 51 bumping to force the stop 104 to depart from the limiting grooves 10031.

Figure 17:
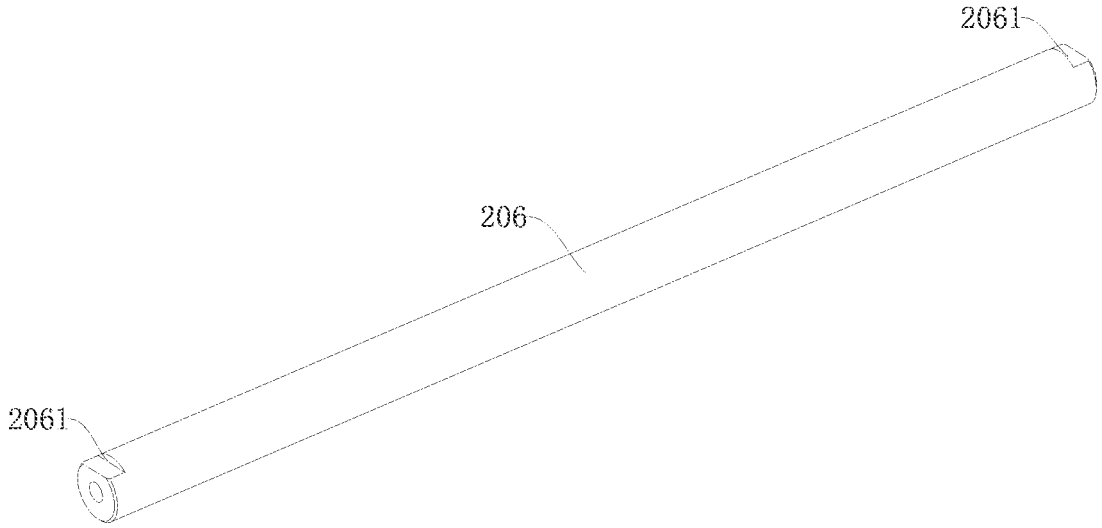
FIG. 17 is a schematic diagram of a fixing shaft's structure according to embodiment two of the present invention.
Figure 18:
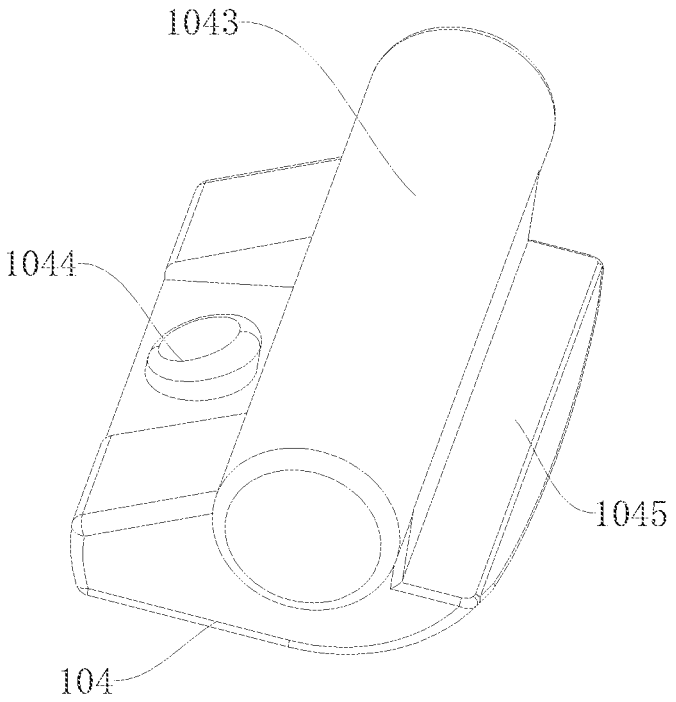
FIG. 18 is a schematic diagram of a stop's structure according to embodiment two of the present invention.
Figure 19:
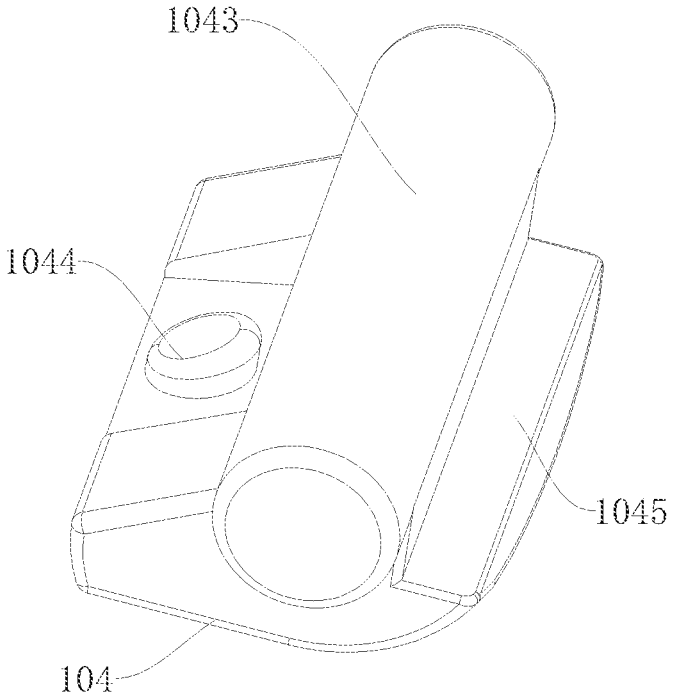
FIG. 19 is a section view of a stop according to embodiment two of the present invention.

As shown in FIG. 17, two ends of the fixing shaft 206 are provided with cuts 2061, each of the tailstock components 2 further comprises a fixing plate 205 and a tailstock end cover 204 disposed at an outer side of the tailstock rear cover 203, a middle part of the fixing plate 205 is provided with a pin hole 2051, the pin hole 2051 matches with the cuts 2061 in shape, and the fixing shaft 206 is limited to be non-rotatable through coordination of the cuts 2061 and the pin hole 2051.

Figure 13:
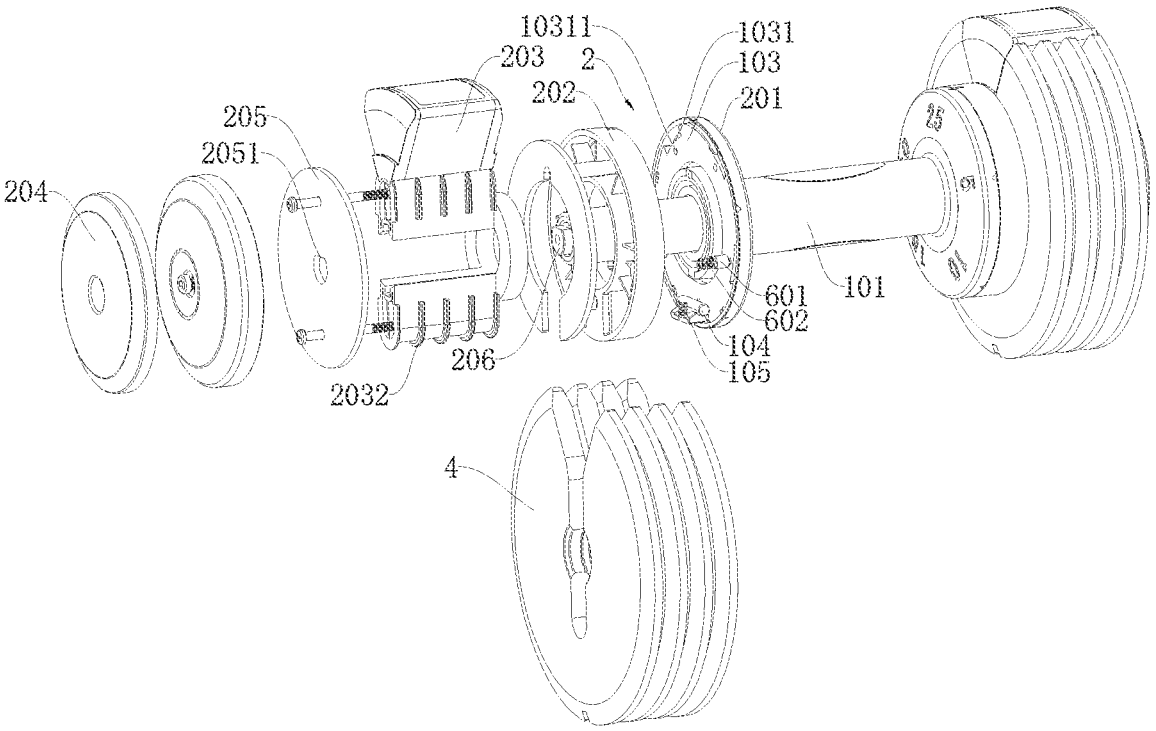
FIG. 13 is a schematic diagram of a local explosion structure according to embodiment two of the present invention.
Figure 14:
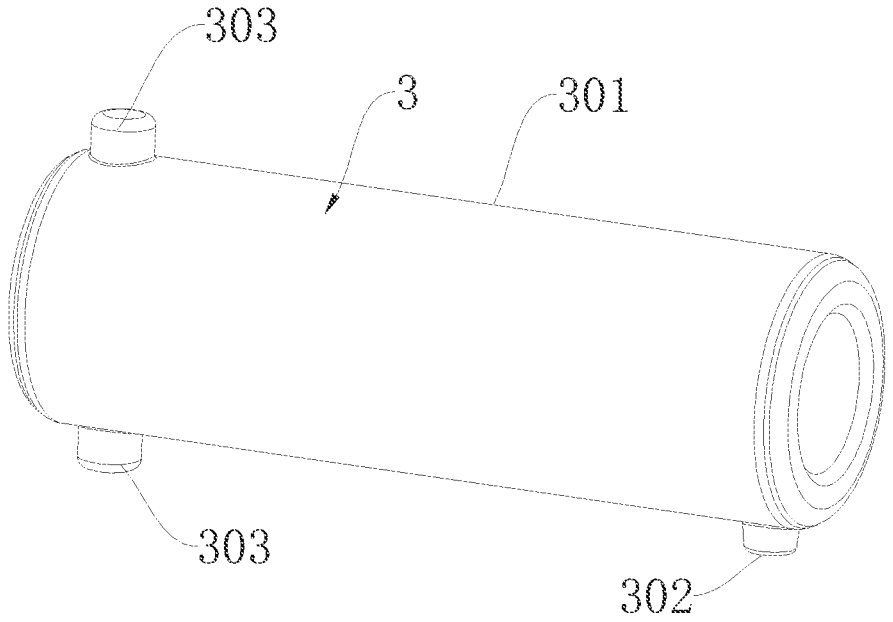
FIG. 14 is a schematic diagram of a slider's structure according to embodiment two of the present invention.
Figure 15:
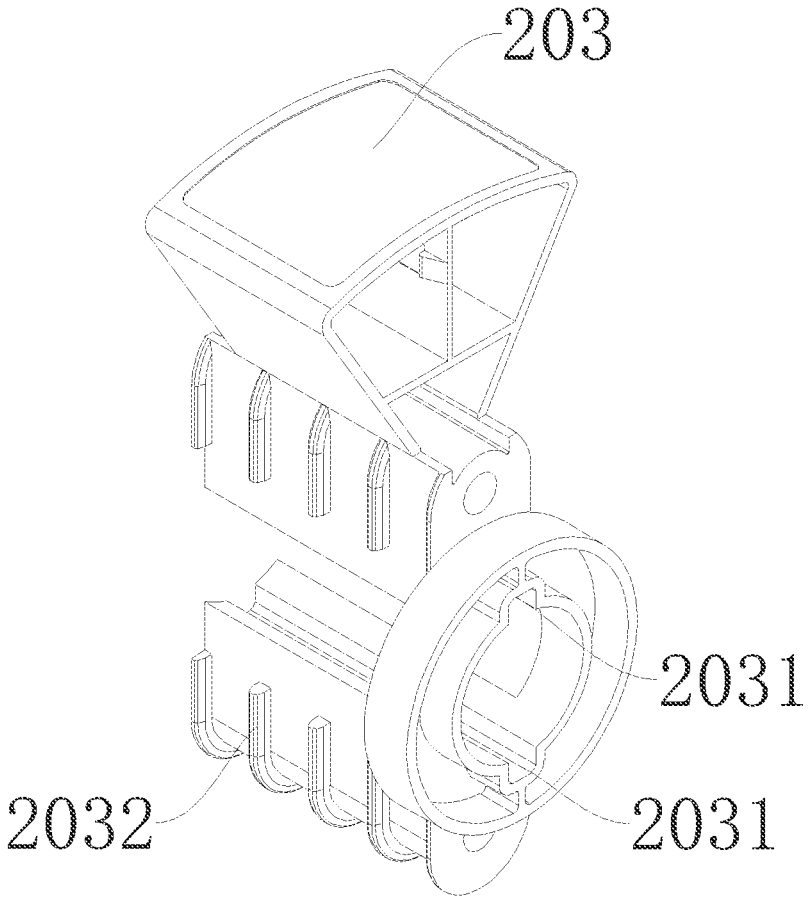
FIG. 15 is a schematic diagram of a tailstock rear cover's structure according to embodiment two of the present invention.

As shown in FIGS. 13 and 20, an inner side of the tailstock inner cover 202 is symmetrically provided with at least two mounting holes 2024, a positioning ejector pin 601 is mounted inside one of the mounting holes 2024, an ejector pin spring 602 is mounted between the positioning ejector pin 601 and the mounting holes 2024, a plurality of mounting holes 2024 are positioned on one same circumference, a positioning hole 10311 is provided at a center line position of one of the limiting grooves 1031 corresponding to an outer side of each of the limiting grooves 1031 and the plurality of the mounting holes 2024 and the positioning hole 10311 have the same circumferential diameter. Two ends at an outer side of the tailstock front cover 201 are imprinted with weight scale around, and the tailstock inner cover 202 is imprinted with an indicating groove for alignment of the weight scale to indicate an adjusted weight.

Embodiment Three

Please referring to FIGS. 21-32, the present invention provides a technical solution as follows: a weight-adjustable dumbbell component with a locking mechanism, comprising a dumbbell component 10, a dumbbell seat 5 and a plurality of dumbbell pieces 4 placed at two sides of the dumbbell seat 5, wherein the dumbbell component 10 comprises a handle component 1, tailstock components 2 disposed at two sides of the handle component 1 and two sliders 3 movably connected to two ends of the handle component 1, the handle component 1 is rotatably connected between two tailstock components 2, the handle component 1 comprises a handle tube 101, wherein the handle tube 101 is a hollow tube and two guiding grooves 1011 with opposite bolt directions are disposed at an inner wall of the handle component 101, each of the sliders 3 comprises a pipe sleeve 301, wherein one end of the pipe sleeve 301 close to the handle component 1 is provided with a guiding block 302 and the other end thereof is provided with a rotation stopping block 303, the tailstock components 2 are provided with rotation stopping grooves 2031 thereon, the guiding block 302 is slidably mounted inside one of the guiding grooves 1011, the rotation stopping block 303 is mounted inside one of the rotation stopping grooves 2031, rotating the handle component 1 can drive the sliders 3 to move slidably inside one of the rotation stopping grooves 2031, each of the tailstock component 2 comprises a tailstock rear cover 203 provided with the rotation stopping grooves 2031 and a fixing shaft 206 disposed inside the handle tube 101 in a penetrating manner, middle parts of the dumbbell pieces 4 are provided with fixing holes 401 for insertion of the sliders 3, upper ends of the fixing holes 401 are provided with opening grooves 402 communicating therewith, a width of the opening grooves 402 is smaller than a diameter of the sliders 3, and the width of the opening grooves 402 is greater than a diameter of the fixing shaft 206.

Each of the tailstock components 2 further comprises a tailstock front cover 201 and a tailstock inner cover 202, wherein the tailstock front covers 201 are fixedly mounted to two sides of the handle tube 101 and can rotate synchronously with the handle tube 101, one side of the tailstock front cover 201 remote from the handle tube 101 is provided with a plurality of limiting grooves 1031, a lower end of the tailstock inner cover 202 is slidably connected with a stop 104, the stop 104 can be clamped into the limiting grooves 1031 to limit rotation of the handle component 1 and the tailstock front cover 201 relative to one of the tailstock components 202.

A lower end of the tailstock inner cover 202 is provided with a mounting groove 2021, the stop 104 is movably mounted inside the mounting groove 2021, and a return spring 105 is mounted between the stop 104 and the mounting groove 2021, the return spring 105 forcing the stop 104 to press in the limiting grooves 1031.

An embossed clamping block 1045 is provided on the stop 104, a top end of the stop 104 is provided with a placing hole 1042, one side of the tailstock front cover 201 remote from the handle tube 101 is provided with a plurality of limiting grooves 1031, the clamping block 1045 is clamped inside the limiting grooves 1031, one end of the return spring 105 is mounted inside the placing hole 1042 and the other end of the return spring 105 abuts against a top end of the mounting groove 2021.

An ejector pin 51 is disposed at a corresponding mounting groove 2021 on the dumbbell seat 5, the ejector pin 51 bumping to force the stop 104 to depart from the limiting grooves 10031.

Two ends of the fixing shaft 206 are provided with cuts 2061, each of the tailstock components 2 further comprises a fixing plate 205 and a tailstock end cover 204 disposed at an outer side of the tailstock rear cover 203, a middle part of the fixing plate 205 is provided with a pin hole 2051, the pin hole 2051 matches with the cuts 2061 in shape, and the fixing shaft 206 is limited to be non-rotatable through coordination of the cuts 2061 and the pin hole 2051.

An inner side of the tailstock inner cover 202 is symmetrically provided with at least two mounting holes 2024, a positioning ejector pin 601 is mounted inside one of the mounting holes 2024, an ejector pin spring 602 is mounted between the positioning ejector pin 601 and the mounting holes 2024, a plurality of mounting holes 2024 are positioned on one same circumference, a positioning hole 10311 is provided at a center line position of one of the limiting grooves 1031 corresponding to an outer side of each of the limiting grooves 1031 and the plurality of the mounting holes 2024 and the positioning hole 10311 have the same circumferential diameter. Two ends at an outer side of the tailstock front cover 201 are imprinted with weight scale around, and the tailstock inner cover 202 is imprinted with an indicating groove for alignment of the weight scale to indicate an adjusted weight.

Working principles: firstly, a guiding groove 1011 is provided inside the handle tube 101, the guiding block 302 at one end of one of the sliders 3 is mounted inside the guiding groove 1011, the rotation stopping block 303 at the other end of the one of the sliders 3 is provided inside one of the rotation stopping grooves 2031 and the sliders 3 are not rotatable. When the handle tube 101 rotates, the guiding groove 1011 inside the handle tube 101 can pull the one of the sliders 3 to move leftward or rightward. When the sliders 3 move toward a handle 101 direction, the dumbbell pieces 4 can be dismounted due to a width of opening grooves of the dumbbell pieces is greater than an outer diameter of a fixing shaft 206, so as to finish dismounting or mounting operation of the dumbbell pieces 4. Under effect of the return spring 105, the stop 104 mounted at a lower end of the tailstock inner cover 202 is made to clamp into the limiting grooves 1031 of the rotating disk 103 (or to clamp into the limiting grooves 1031 disposed on the tailstock front cover 201). At this moment, due to synchronously rotatable connection of the rotating disk 103, the handle tube 101 and the limiting iron plate 102 (synchronously rotatable connection of the handle tube 101 and the tailstock front cover 201), the handle thus cannot rotate, so as to prevent the dumbbell pieces falling off when the dumbbell is in use. A bumping ejector pin 51 is disposed at a corresponding stop 104 on the dumbbell seat 5. The ejector pin 51 can pop stop 104 up to depart from the limiting grooves 1031, such that after placing the dumbbell into a base, the rotation locking of the stop 104 over the handle tube 101 can be discharged, that is, the handle tube 101 can be rotated, so as to finish dismounting or mounting operation of the dumbbell pieces 4.

In embodiments of the present application, the description of noun-directions like "front", "rear", "left" and "right" is merely description made according to the directions shown in the accompanying drawings shown in the present application, but not to be limited to restrictions over the protection scope of the claims in the present application. In a specific implementation process, corresponding deformations can be made thereto according to the embodiments, thereby obtaining other same or similar embodiments, which all fall into the protection scope of the present application. Moreover, other similar or same embodiments are not stated repeatedly in the present application.

In the description of the present invention, it should be noted that unless otherwise prescribed and defined clearly, terms like "mounting", "communicating" and "connection" should be understood in a broad sense, which for example can be a fixed connection and can also be a detachable connection or an integral connection; can be a mechanic connection and can also be an electrical connection, can be a direct connection and can also be an indirect connection through an intermediary, and can also be communication inside two elements. For those skilled in the art, the specific meanings of the above terms in the invention can be understood depending on specific situations.

Finally, it should be noted that the foregoing contents are merely intended to describe the technical solutions of the present invention, but not to limit the protection scope of the present invention. Simple modifications or equivalent replacements made by those skilled in the art to the technical solutions of the present invention are not departed from the substance and scope of the technical solutions of the present invention.

The invention claimed is:

1. A weight-adjustable dumbbell component with a locking mechanism, comprising a dumbbell component (10), a dumbbell seat (5) and a plurality of dumbbell pieces (4) placed at two sides of the dumbbell seat (5), characterized in that the dumbbell component (10) comprises a handle component (1), tailstock components (2) disposed at two sides of the handle component (1) and two sliders (3) movably connected to two ends of the handle component (1), wherein the handle component (1) is rotatably connected between two tailstock components (2), wherein the handle component (1) comprises a handle tube (101), wherein the handle tube (101) is a hollow tube and two guiding grooves (1011) with opposite bolt directions are disposed at an inner wall of the handle tube (101), wherein each of the sliders (3) comprises a pipe sleeve (301), wherein one end of the pipe sleeve (301) close to the handle component (1) is provided with a guiding block (302) and the other end thereof is provided with a rotation stopping block (303), wherein the tailstock components (2) are provided with rotation stopping grooves (2031) thereon, wherein the guiding block (302) is slidably mounted inside one of the guiding grooves (1011), wherein rotation stopping block (303) is mounted inside one of the rotation stopping grooves (2031), wherein rotating the handle component (1) can drive the sliders (3) to move slidably inside the rotation stopping grooves (2031), wherein each of the tailstock components (2) comprises a tailstock rear cover (203) provided with one of the rotation stopping grooves (2031) and a fixing shaft (206) disposed inside the handle tube (101) in a penetrating manner, wherein middle parts of the dumbbell pieces (4) are provided with fixing holes (401) for insertion of the sliders (3), wherein upper ends of the fixing holes (401) are provided with opening grooves (402) communicating therewith, a width of the opening grooves (402) is smaller than a diameter of the sliders (3), wherein and the width of the opening grooves (402) is greater than a diameter of the fixing shaft (206).

2. The weight-adjustable dumbbell component with a locking mechanism as claimed in claim 1, characterized in that each of the tailstock components (2) further comprises a tailstock front cover (201) and a tailstock inner cover (202), wherein the tailstock front covers (201) are fixedly mounted to two sides of the handle tube (101) and can rotate synchronously with the handle tube (101), wherein one side of the tailstock front cover (201) remote from the handle tube (101) is provided with a plurality of limiting grooves (1031), wherein a lower end of the tailstock inner cover (202) is slidably connected with a stop (104), wherein the stop (104) can be clamped into the limiting grooves (1031) to limit rotation of the handle component (1) relative to one of the tailstock components (2).

3. The weight-adjustable dumbbell component with a locking mechanism as claimed in claim 2, characterized in that an inner side of the tailstock inner cover (202) is symmetrically provided with at least two mounting holes (2024), wherein a positioning ejector pin (601) is mounted inside each of the mounting holes (2024), wherein an ejector pin spring (602) is mounted between the positioning ejector pin (601) and a corresponding one of the mounting holes (2024), wherein a plurality of mounting holes (2024) are positioned on one same circumference, wherein a positioning hole (10311) is provided at a center line position of each of the limiting grooves (1031) corresponding to an outer side of each of the limiting grooves (1031), wherein and the plurality of the mounting holes (2024) and the positioning hole (10311) have the same circumferential diameter.

4. The weight-adjustable dumbbell component with a locking mechanism as claimed in claim 1, characterized in that the handle component (1) comprises a limiting iron plate (102) capable of rotating synchronously with the handle tube (101), wherein the limiting iron plate (102) is bolt-connected to the handle tube (101), wherein an outer side of the limiting iron plate (102) is fixedly connected with a rotating disk (103), wherein the rotating disk is of a round shape and is provided with a plurality of limiting grooves (1031) thereon, wherein each of the tailstock components (2) comprises a tailstock front cover (201) and a tailstock inner cover (202), wherein the limiting iron plate (102) and the rotating disk (103) are disposed between the tailstock front cover (201) and the tailstock inner cover (202), wherein a lower end of the tailstock inner cover (202) is slidably connected with a stop (104), wherein the stop (104) can be clamped in the limiting grooves (1031) to limit rotation of the handle component (1) relative to one of the tailstock components (2).

5. The weight-adjustable dumbbell component with a locking mechanism as claimed in claim 4, characterized in that a lower end of the tailstock inner cover (202) is provided with a mounting groove (2021), wherein the stop (104) is movably mounted inside the mounting groove (2021), and a return spring (105) is mounted between the stop (104) and the mounting groove (2021), the return spring forcing the stop (104) to press into the limiting grooves (1031).

6. The weight-adjustable dumbbell component with a locking mechanism as claimed in claim 5, characterized in that a middle part of the stop (104) is provided with a clamping groove (1041), wherein a top end of the stop (104) is provided with a placing hole (1042), wherein upper and lower end surfaces of the stop (104) and upper and lower end surfaces of the clamping groove (1041) all have a shape of circular arc, wherein an inner circular ring of the rotating disk (103) is provided with a plurality of limiting grooves (1031), wherein the rotating disk (103) is disposed inside the clamping groove (1041), wherein one end of the return spring (105) is mounted inside the placing hole (1042) and the other end of the return spring (105) abuts against a top end of the mounting groove (2021).

7. The weight-adjustable dumbbell component with a locking mechanism as claimed in claim 5, characterized in that an inner side surface of the mounting groove (2021) is provided with an opening groove (2022), wherein an upper end surface of the mounting groove (2021) is provided with a fixing groove (2023), wherein a locking mechanism is mounted inside the mounting groove (2021), wherein the locking mechanism comprises a return spring (105) and a stop (104), wherein two ends of the stop (104) are provided with rotary pins (1043), wherein a front side of the stop (104) is provided with a bump (1044), wherein a rear side of the stop (104) is provided with a clamping block (1045), wherein a lower end surface of the stop (104) is provided with a recess (1046), wherein the stop (104) is rotatably mounted inside the opening groove (2022) through the rotating pins (1043), an upper end of the return spring (105) is mounted inside the fixing groove (2023) and a lower end of the return spring (105) is fixed on the bump (1044), wherein an outer circular ring of the rotating disk (103) is provided with a plurality of limiting grooves (1031), wherein and the clamping block (1045) is clamped inside the limiting grooves (1031).

8. The weight-adjustable dumbbell component with a locking mechanism as claimed in claim 5, characterized in that an ejector pin (51) is disposed at a corresponding mounting groove (2021) on the dumbbell seat (5), the ejector pin bumping to force the stop (104) to depart from the limiting grooves (1031).

9. The weight-adjustable dumbbell component with a locking mechanism as claimed in claim 1, characterized in that two ends of the fixing shaft (206) are provided with cuts (2061), wherein each of the tailstock components (2) further comprises a fixing plate (205) and a tailstock end cover (204) disposed at an outer side of the tailstock rear cover (203), wherein a middle part of the fixing plate (205) is provided with a pin hole (2051), wherein the pin hole (2051) matches with the cuts (2061) in shape, and wherein the fixing shaft (206) is limited to be non-rotatable through coordination of the cuts (2061) and the pin hole (2051).

10. The weight-adjustable dumbbell component with a locking mechanism as claimed in claim 1, characterized in that two ends at an outer side of the handle tube (101) are imprinted with weight scale around, and wherein the tailstock front cover (201) is imprinted with an indicating groove for alignment of the weight scale to indicate an adjusted weight.

* * * * *